US007171915B1

(12) United States Patent
Rutan

(10) Patent No.: US 7,171,915 B1
(45) Date of Patent: Feb. 6, 2007

(54) WATER-STABLE INFLATABLE PONTOON BOAT TRANSPORTABLE BY TRAILER

(76) Inventor: Don Rutan, P.O. Box 58, Rough and Ready, CA (US) 95975

( * ) Notice: Subject to any disclaimer, the term of this patent is extended or adjusted under 35 U.S.C. 154(b) by 19 days.

(21) Appl. No.: 11/016,679

(22) Filed: Dec. 16, 2004

(51) Int. Cl.
*B63B 1/10* (2006.01)
*B63B 7/00* (2006.01)
*B63B 7/08* (2006.01)
*B63B 35/36* (2006.01)

(52) U.S. Cl. ..... 114/61.15; 114/61.25; 114/292; 114/353; 114/354

(58) Field of Classification Search ..... 114/61.1, 114/61.15–61.19, 292, 352–354, 61.25, 345
See application file for complete search history.

(56) References Cited

U.S. PATENT DOCUMENTS 2,003,488 A * 6/1935 Hook ..... 285/289.1
2,495,190 A * 1/1950 Stewart ..... 114/283
4,243,242 A 1/1981 Waits
4,754,998 A 7/1988 LeJuerrne
6,003,458 A 12/1999 Valliere
6,164,238 A 12/2000 Stokes
6,988,456 B1 * 1/2006 Schooler ..... 114/61.16

FOREIGN PATENT DOCUMENTS

EP 415793 A1 * 3/1991
JP 63258288 A * 10/1988

* cited by examiner

*Primary Examiner*—Ajay Vasudeva
(74) *Attorney, Agent, or Firm*—Arthur J. Carlson

(57) ABSTRACT

A boat having inflatable pontoons connected therewith by rotatable support assemblies is described. The structure is capable of collapsing to a small size for transport on a trailer, but provides a wide base for stable operation when deployed on water. A foldable deck assembly provides an expanded deck surface and further enhances stability of the boat when in use on water.

18 Claims, 17 Drawing Sheets

WATER-STABLE INFLATABLE PONTOON BOAT TRANSPORTABLE BY TRAILER

BACKGROUND OF THE INVENTION

1. Field of the Invention

The present invention relates generally to watercraft and, more particularly, to expandable watercraft transportable by trailer.

2. Description of Related Art

Recreational watercraft are in popular use on today's lakes and rivers. Recreational watercraft include small craft such as rowboats, low-powered fishing boats, high-powered boats for pulling water skiers, and the like. Other recreational watercraft, which may be classified as large watercraft, include houseboats with facilities sometimes found in manufactured homes used on dry land. Still other watercraft, classified as intermediate-sized watercraft, and which may be referred to as camper watercraft, provide facilities analogous to those found in camping tents and trailers. These camper watercraft, which may comprise pontoons mounted on an underside of a deck structure, attempt to strike a balance between a large size and a small size. The large size may be preferred for stability when in use on water, while a small size may be preferred for convenience in transporting the watercraft on a highway or storing the watercraft in a garage. Generally, an intermediate-sized watercraft small enough to be transported on a highway has pontoons spaced closely enough together that the watercraft does not enjoy a high degree of stability on water. Conversely, an intermediate-sized watercraft large enough to be stable on water may be too large to be conveniently transported by trailer.

In an attempt to compromise between the conflicting requirements of stability on water and ease of transport on land, Valliere, U.S. Pat. No. 6,003,458 describes an expandable pontoon boat that is retractable into a configuration suitable for trailering and expandable to provide additional passenger room. The Valliere invention includes three passenger hull shells and three pontoon assemblies as well as a rack gear mechanism, drive motor, and slip clutch that are used to retract the pontoon assemblies. Another compromise is described in Stokes, U.S. Pat. No. 6,164,238, which discloses a lightweight folding boat having dual hulls that are capable of being folded together, one on top of another, for transport by trailer. Neither of these devices satisfies a need for a low-cost camper watercraft that can be conveniently converted from a form transportable by trailer to a form that provides stable operation on water.

SUMMARY OF THE INVENTION

An embodiment of the present invention provides a boat having inflatable pontoons that can be conveniently retracted for transporting the boat on a trailer. When in use on water, the pontoons may be extended beyond the sides of the boat, thereby providing a wide base of support that may enhance stable operation. The invention herein disclosed comprises, according to an exemplary embodiment, a primary deck. A plurality of support assemblies is connected to a lower surface of the primary deck, and a plurality of inflatable pontoons is connected to the plurality of support assemblies. When extended, and with the plurality of inflatable pontoons inflated, the plurality of support assemblies in this exemplary embodiment is capable of supporting the boat. When the plurality of inflatable pontoons is deflated and the plurality of support assemblies is retracted, the boat is capable of being transported on a trailer.

Another embodiment of the present invention comprises an outrigger assembly having a first hollow tube that includes a first beveled end. This embodiment further comprises a second hollow tube aligned with and rotatably secured to the first hollow tube, the second hollow tube having a second beveled end capable of mating with the first beveled end. The embodiment still further comprises a support bar slidably disposed within the first hollow tube and the second hollow tube, the support bar having a third beveled end oriented at a nominal right angle to the second beveled end.

The present invention further includes a method, an exemplary variation of which comprises providing a boat having a primary deck. This variation of the method further comprises providing a plurality of support assemblies connected to an underside of the primary deck. A plurality of inflatable pontoons also is provided, the plurality of inflatable pontoons being connected to the plurality of support assemblies. This variation of the method still further comprises extending the plurality of support assemblies and inflating the plurality of inflatable pontoons, thereby rendering the boat usable on water. The variation also includes retracting the plurality of support assemblies and deflating the plurality of inflatable pontoons, thereby rendering the boat transportable by a trailer.

While the apparatus and method has or will be described for the sake of grammatical fluidity with functional explanations, it is to be expressly understood that the claims, unless expressly formulated under 35 U.S.C. 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 U.S.C. 112 are to be accorded full statutory equivalents under 35 U.S.C. 112.

Any feature or combination of features described herein are included within the scope of the present invention provided that the features included in any such combination are not mutually inconsistent as will be apparent from the context, this specification, and the knowledge of one skilled in the art. For purposes of summarizing the present invention, certain aspects, advantages and novel features of the present invention are described herein. Of course, it is to be understood that not necessarily all such aspects, advantages or features will be embodied in any particular embodiment of the present invention. Additional advantages and aspects of the present invention are apparent in the following detailed description and claims that follow.

DETAILED DESCRIPTION

Figure 1:
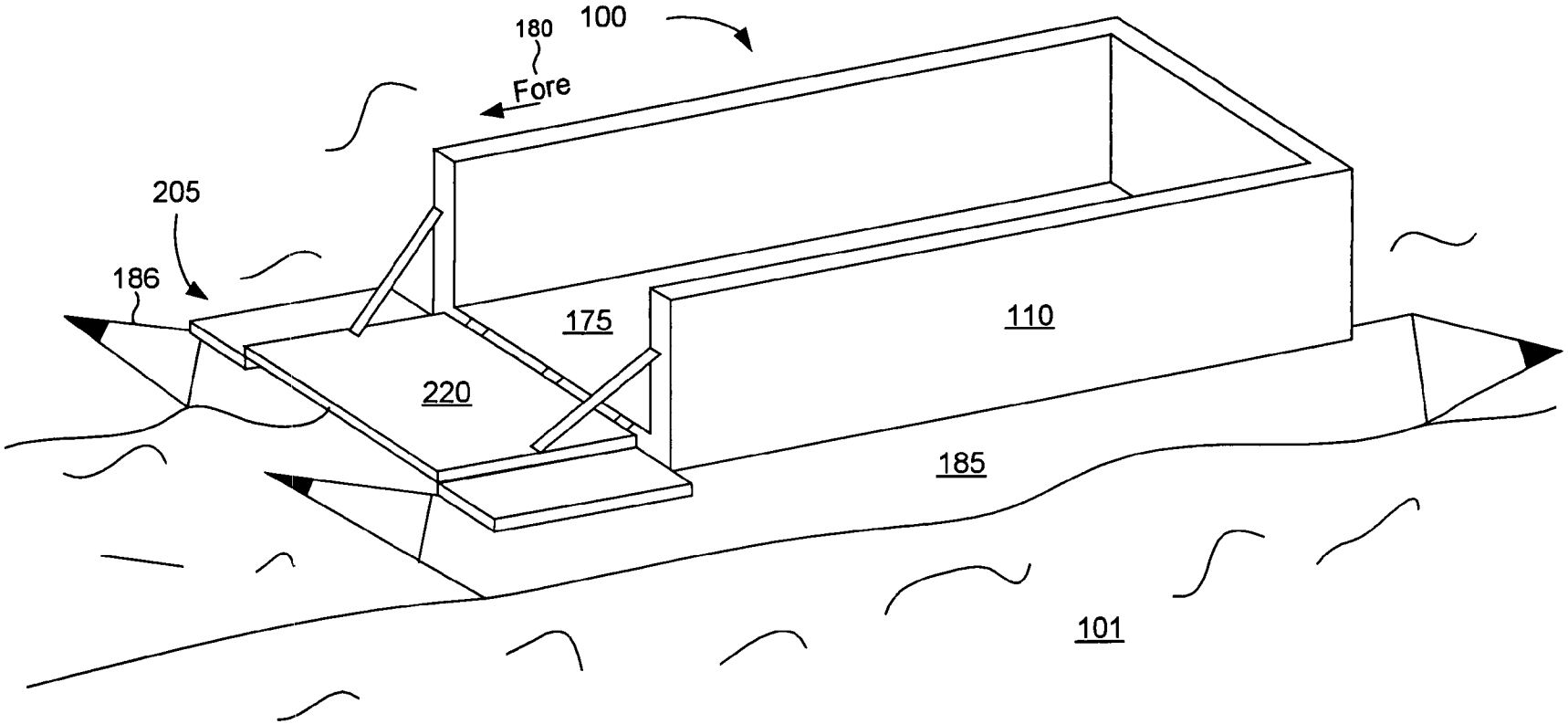
FIG. 1 is a pictorial diagram showing an example of a concept of a pontoon boat constructed according to the present invention.

Reference will now be made in detail to embodiments of the invention, examples of which are illustrated in the accompanying drawings. Wherever possible, the same or similar reference numbers are used in the drawings and the description to refer to the same or like parts. It should be noted that the drawings are in simplified form and are not to precise scale. In reference to the disclosure herein, for purposes of convenience and clarity only, directional terms, such as fore, top, bottom, left, right, up, down, over, above, below, beneath, rear, and front, are used with respect to the accompanying drawings. Such directional terms should not be construed to limit the scope of the invention in any manner.

Although the disclosure herein refers to certain illustrated embodiments, it is to be understood that these embodiments are presented by way of example and not by way of limitation. The intent of the following detailed description, although discussing exemplary embodiments, is to be construed to cover all modifications, alternatives, and equivalents of the embodiments as may fall within the spirit and scope of the invention as defined by the appended claims. It is to be understood and appreciated that the process steps and structures described herein do not cover a complete process flow for the manufacture and operation of inflatable pontoon boats. The present invention may be practiced in conjunction with various manufacturing techniques that are conventionally used in the art, and only so much of the commonly practiced process steps are included herein as are necessary to provide an understanding of the present invention. The present invention has applicability in the field of watercraft in general. For illustrative purposes, however, the following description pertains to a pontoon boat with inflatable pontoons and to a method of operating the boat in order to transport the boat on land or to deploy the boat on water.

Referring more particularly to the drawings, FIG. 1 is a pictorial diagram showing an example of a pontoon boat constructed according to the present invention. The illustrated embodiment comprises a boat 100, to which is secured pontoons 185 and 186 that support the boat 100 as it floats in water 101. The pontoons 185 and 186 are connected with the boat 100 in a manner more particularly described below. A typical embodiment of the boat 100 comprises a primary deck 175 having sidewalls 110. A foldable deck assembly 205 may be rotatably secured to the primary deck 175 with hinges (not shown). In typical embodiments, the boat 100 may further comprise a cover such as a collapsible fold-out tent (not shown). As an example, the illustrated embodiment shows the foldable deck assembly 205 disposed on a fore end 180 of the boat 100.

Figure 2:
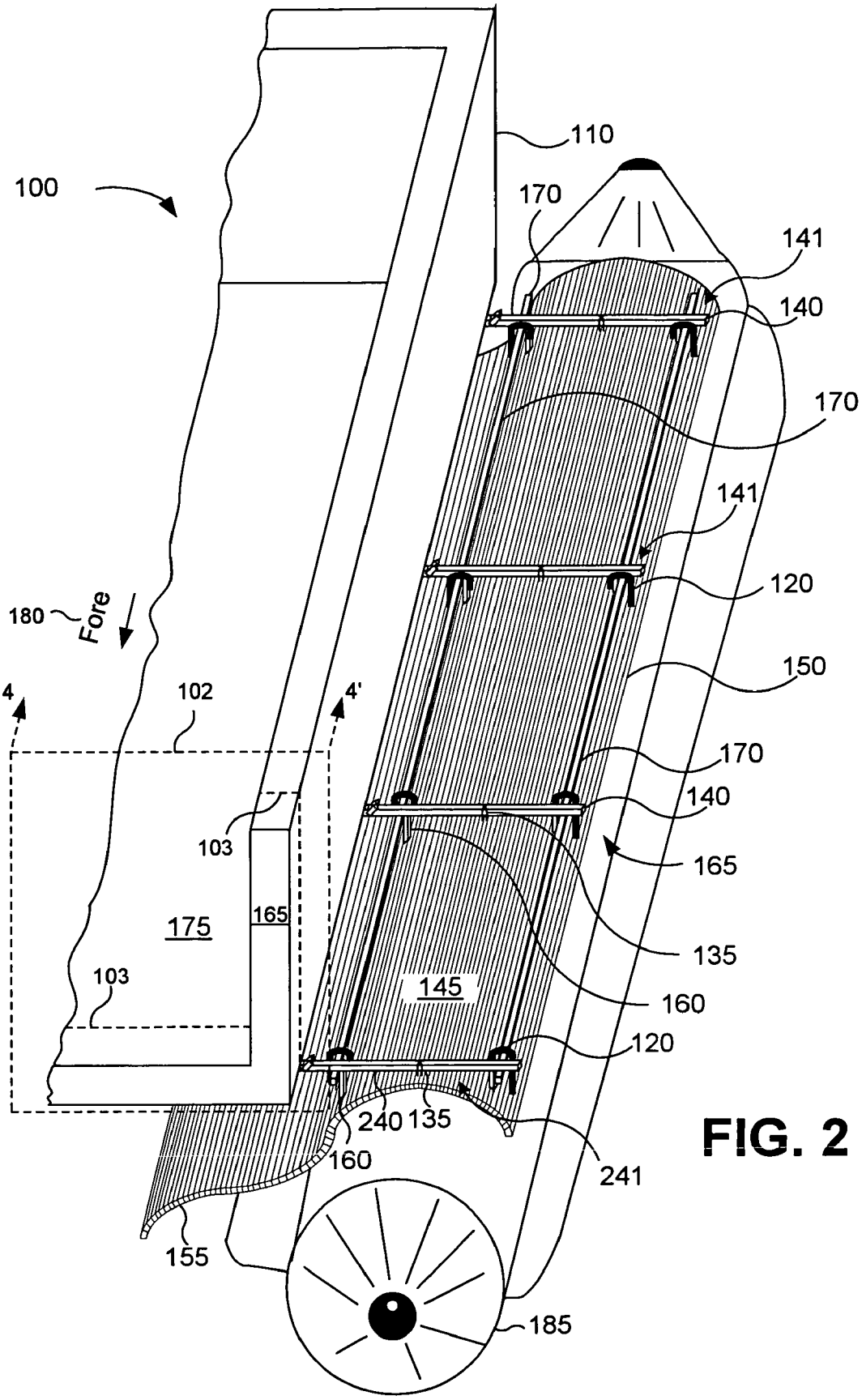
FIG. 2 is a partial pictorial diagram of an embodiment of a boat having a plurality of pontoons.

FIG. 2 is a partial pictorial diagram of another embodiment of a boat 100 having a plurality of support assemblies to which is secured a plurality of pontoons. Although typical embodiments may include two support assemblies and two pontoons as illustrated in FIG. 1, only a single support assembly 165 and a single pontoon 185 are illustrated in FIG. 2 for simplicity. The support assembly 165 comprises a plurality of outrigger assemblies 141, a plurality of parallel rods 170, and restraining material 150 according to the present invention. The embodiment of the support assembly 165 illustrated in FIG. 2 comprises two parallel rods 170. The two parallel rods 170 are secured to the pontoon 185 with a plurality of fastening loops 120 that may be provided as part of commercially available pontoons. The plurality of outrigger assemblies 141 is oriented generally perpendicular to and overlying the plurality of parallel rods 170. An outrigger assembly 241 representative of the plurality of outrigger assemblies 141 comprises a nominally square first hollow tube (not shown) secured to an underside of the primary deck 175. A likewise nominally square second hollow tube 240, which, as is true of the first hollow tube, may be made of steel, is rotatably secured to the first hollow tube as is more particularly described below with reference to FIGS. 4–7. The second hollow tube may have secured (e.g., welded) thereto a plurality of pontoon alignment spacers 160.

The restraining material 150 illustrated in FIG. 2 is disposed between the plurality of outrigger assemblies 141 and the pontoon 185 to form a saddle 145 that may distribute weight of the boat 100 over a length of the pontoon 185. In the illustrated embodiment, restraining material 150 also supports the two parallel rods 170, which lie on an underside of the plurality of outrigger assemblies 141 in a position adjacent to the plurality of pontoon alignment spacers 160. According to a representative embodiment, about half of the restraining material 150 is used to form the saddle 145, and the remaining restraining material is designated as additional restraining material 155. The additional restraining material 155 may lie beneath the primary deck 175 when the boat 100 is in water. When the boat 100 is configured for transport, the additional restraining material 155 may aid in securing deflated pontoons in a manner more particularly described below is a discussion of FIGS. 11 and 12. According to a representative embodiment, the restraining material 150 is composed of plastic of a type sometimes used to form bed liners for pickup trucks. Fasteners, e.g., a plurality of wire loops 135, may fasten the saddle 145 to the plurality of outrigger assemblies 141.

The plurality of outrigger assemblies 141 may be secured to an underside of the boat 100 in the illustrated embodiment, e.g., by welding. The plurality of outrigger assemblies 141 may be locked in an extended, nominally horizontal position in a manner more particularly described below. When in water, the pontoon 185 may support the support assembly 165 (with the plurality of outrigger assemblies 141 horizontally locked), and, thereby, partially support the boat 100. In a typical embodiment, the boat 100 is supported on a side thereof by at least one such pontoon, and at least one support assembly. The typical embodiment further has support on another side of the boat 100 provided by at least one other pontoon and at least one other support assembly. In diagrams to follow, only one side of a boat 100 is shown for convenience. It will be understood that an opposite side of the boat 100 normally may be configured according to a mirror image of the illustrations shown in the diagrams.

Figure 3:
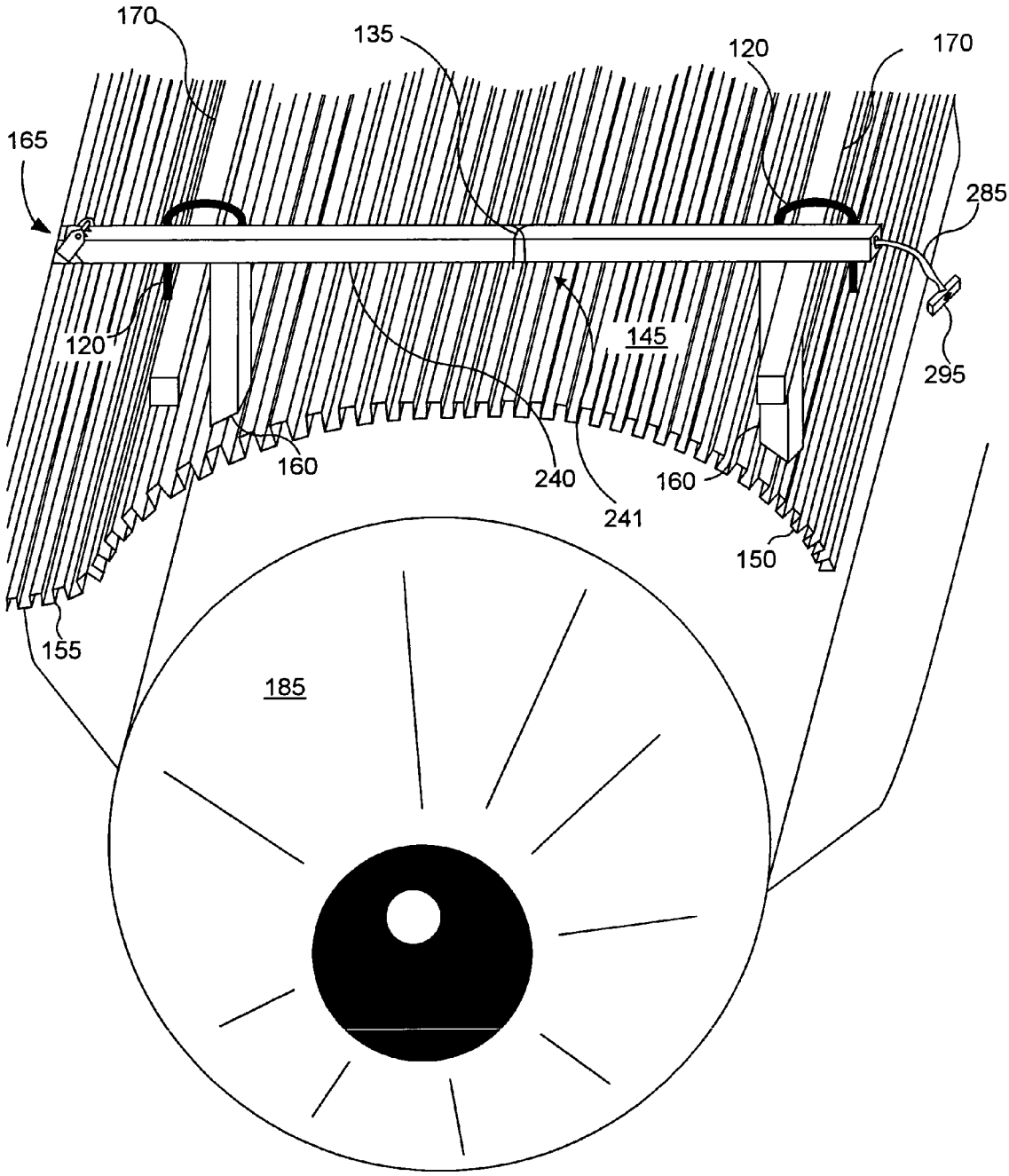
FIG. 3 is a partial pictorial diagram illustrating detail of a portion of an embodiment of a pontoon and a support assembly configured in accordance with the present invention.

FIG. 3 is a partial pictorial diagram illustrating detail of a portion of an embodiment of a pontoon 185 and a support assembly 165 (FIG. 2) configured in accordance with the present invention. Two pontoon alignment spacers 160 that are secured to the second hollow tube 240, e.g. by welding, and adjacent to which the two parallel rods 170 may be placed, are shown in detail in FIG. 3. The second hollow tube 240 may have a support bar 265 disposed therein as illustrated below in FIGS. 4–6. The support bar 265 further may have an attached connecting means 285, itself attached to a pull handle 295 as shown in FIG. 3 and as described in more detail below with reference to FIGS. 5 and 6.

Figure 4:
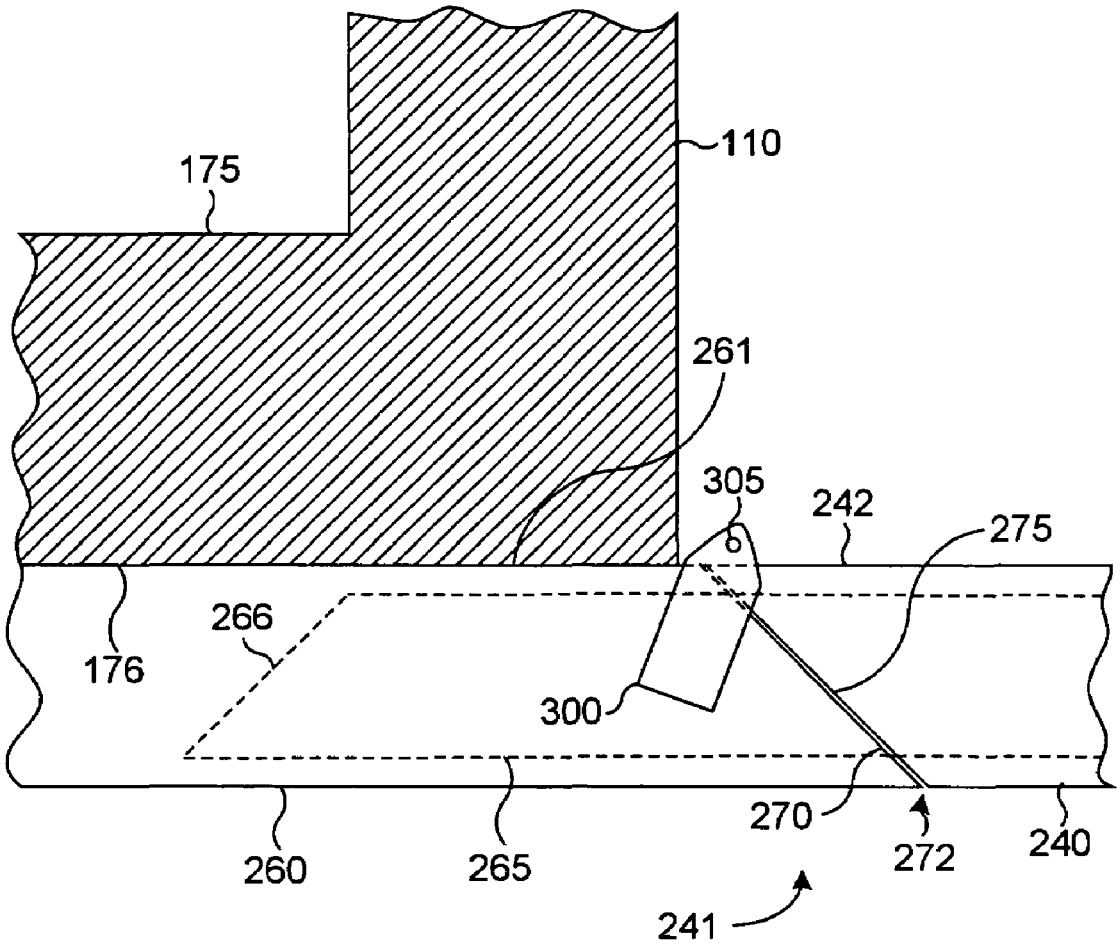
FIG. 4 is a side view of an exemplary embodiment of a portion of a representative outrigger assembly selected from the plurality of outrigger assemblies shown in FIG. 2.

FIG. 4 is a side view of an exemplary embodiment of a portion of a representative outrigger assembly 241 selected from the plurality of outrigger assemblies 141 shown in FIG. 2. The portion of the representative outrigger assembly 241 illustrated in FIG. 4 comprises a nominally square first hollow tube 260 having a first beveled end 270 and mounted on an underside 176 of a primary deck 175. The representative outrigger assembly 241 further comprises a second hollow tube 240 having a nominally square cross-section and a second beveled end 275. A cross-section 4–4' (FIG. 2) of the primary deck 175 and a sidewall 110 is shown in FIG. 4 as defined by an imaginary plane 102 (FIG. 2) that makes a corresponding imaginary cut 103 (FIG. 2) in the primary deck 175 and sidewall 110. The cross-section is taken along a plane defined by a vertical edge of the first hollow tube 260.

According to an exemplary embodiment, an upper surface 261 of the first hollow tube 260 is secured to the underside 176 of the primary deck 175 by welding. The first beveled end 270 of the first hollow tube 260 may mate with the second beveled end 275 of the second hollow tube 240. The second hollow tube 240 aligns with and may be separated from the first hollow tube 260 by a small gap 272, the size of which may range from about 0.01 inch to about 0.05 inch in a typical embodiment. A pair of brackets 300 (only one bracket 300 is illustrated in FIG. 4) and associated hardware—more particularly described below with reference to FIGS. 5–7—may act to align the second hollow tube 240 and the first hollow tube 260. The representative outrigger assembly 241 still further comprises a supporting bar 265 that fits snuggly, but is free to slide back and forth, inside the first hollow tube 260 and the second hollow tube 240. The supporting bar 265 has a third beveled end 266 oriented at a nominal right angle with respect to the second beveled end 275. It should be noted that the second hollow tube 240 may be allowed to rotate about an axis of a pin 305 connected to the pair of brackets 300 when the supporting bar 265 is moved to a position far enough to the right that the supporting bar 265 no longer contacts the first hollow tube 260.

Figure 5:
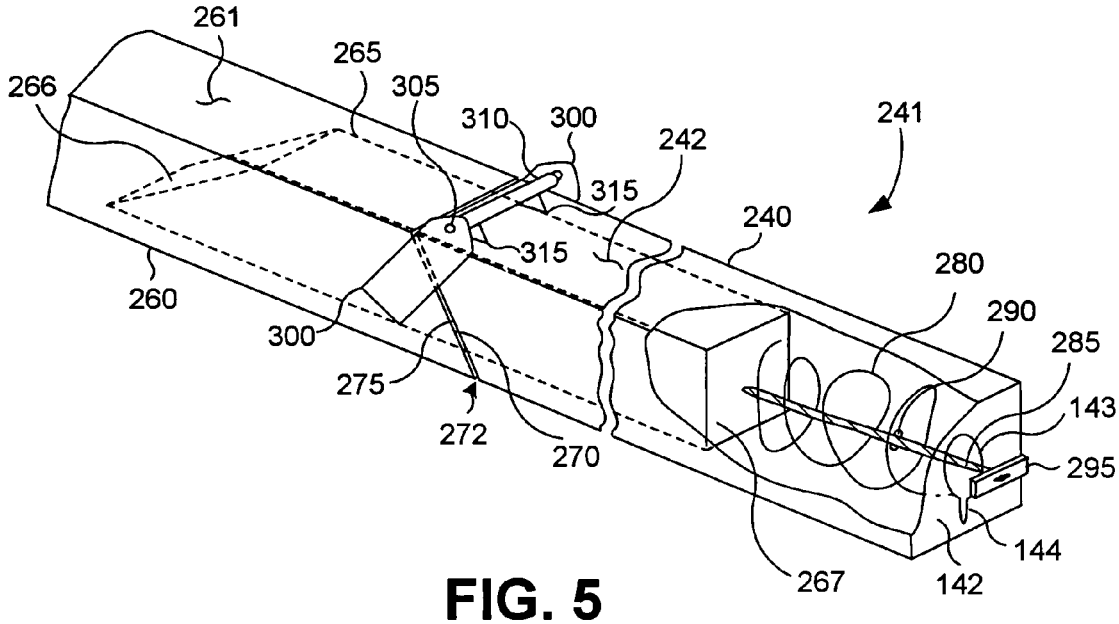
FIG. 5 is a pictorial diagram of the representative outrigger assembly shown in FIG. 4 showing a support bar in an extended position.

FIG. 5 is a pictorial diagram of the representative outrigger assembly 241 shown in FIG. 4 showing the support bar 265 in an extended position. A pair of brackets 300 may be secured (e.g., by welding) to sides of the first hollow tube 260, the pair of brackets 300 extending over an upper surface 242 of the second hollow tube 240. A sleeve 310 may be secured (e.g., by welding) to the upper surface 242 of the second hollow tube 240 with mounting brackets 315. A pin 305 secured to both of the pair of brackets 300 may be disposed in the sleeve 310. In a typical embodiment, the upper surface 261 of the first hollow tube 260 is secured to the underside 176 of the primary deck 175 as illustrated in FIG. 4 (not shown in FIG. 5). An end of a connecting means 285 such as a cord, rope, chain, or the like may be secured to an end of the support bar 265 using methods well known in the art, and a pull handle 295 may be fastened to another end of the connecting means 285. According to a representative embodiment, the pull handle 295 is fashioned of material such as wood or plastic and has a hole passing therethrough. An end of the connecting means 285, e.g., an end of a rope, may be passed through the hole, and a knot may be formed in the end of the rope, the knot acting to secure the pull handle 295 to the connecting means 285.

As illustrated in FIG. 5, the support bar 265 may assume a position partially within the first hollow tube 260 and partially within the second hollow tube 240. For example, about half of the length of the support bar 265 may be disposed within the first hollow tube 260, and about half of the length of the support bar 265 may be disposed within the second hollow tube 240. In the illustrated position, the support bar 265 may be said to occupy an extended position, and the second hollow tube 240 may be said to be locked in an extended, nominally horizontal position.

The second hollow tube 240 may comprise an end plate 142 having a hole 143 therein through which the connecting means 285 may protrude. The hole 143 may include a slot 144 on an edge of the hole 143. A spring 280 is interposed between an end 267 of the support bar 265 and the end plate 142 in the illustrated embodiment. The support bar 265 has a length that permits movement in response to tension applied to the connecting means 285. Tension may be applied to the connecting means 285, for example, by grasping the pull handle 295 and pulling in a direction that causes the spring 280 to compress. The length of the support bar 265 may be chosen such that the third beveled end 266 of the support bar 265 is able to move clear of the first hollow tube 260 when sufficient tension is applied to the connecting means 285. When the support bar 265 is positioned clear of the first hollow tube 260, the support bar 265 may be said to be in a retracted position.

Figure 6:
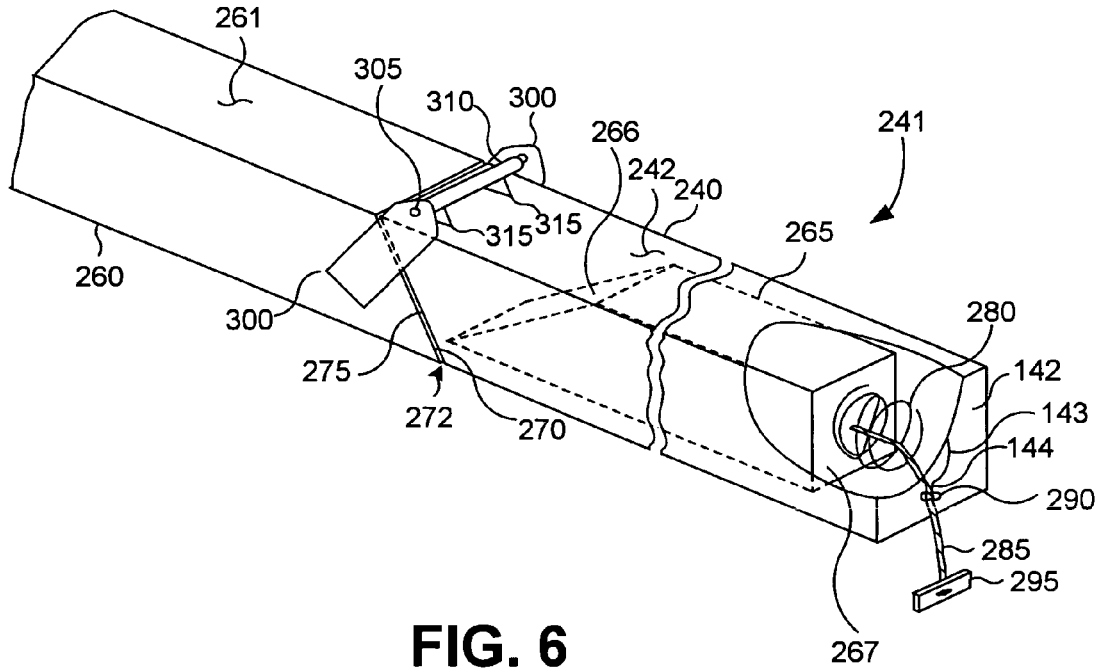
FIG. 6 is a pictorial diagram of the representative outrigger assembly of FIG. 4 showing a support bar in a retracted position.

FIG. 6 is a pictorial diagram of the representative outrigger assembly 241 of FIG. 4 showing the support bar 265 in a retracted position. In order to maintain the retracted position, a portion of the connecting means 285 may be fabricated to have a larger cross-section than the remainder of the connecting means 285. For example, when the connecting means 285 comprises a rope or cord, the larger cross-section may be provided by a knot 290 disposed in the rope or cord that prevents the connecting means 285 from entering the second hollow tube 240 when the connecting means 285 is placed in the slot 144.

Operation of the mechanism illustrated in FIGS. 5 and 6 can proceed as follows. Beginning with the support bar 265 in an extended position as shown in FIG. 5, force may be applied on the pull handle 295 to apply tension to the connecting means 285. The applied force may move the support bar 265 to the retracted position illustrated in FIG. 6. Then, by moving the pull handle 295 downward, the connecting means 285 may be made to pass through the slot 144. The spring 280 may be compressed by the retracted position of the support bar 265, thereby causing tension to be maintained on a portion of the connecting means 285. The tension on the portion of the connecting means 285 may hold the portion of the connecting means 285 having a larger cross-section (e.g., the knot 290) in place outside the slot 144. When held in place outside the slot 144, the larger cross-section portion of the connecting means 285 may prevent the support bar 265 from returning to the extended position shown in FIG. 5.

To extend the support bar 265 when beginning from the retracted position illustrated in FIG. 6, tension may be applied to the connecting means 285 by means of the pull handle 295, and the connecting means 285 may be removed from the slot 144. Releasing tension on the connecting means 285 then may permit the compressed spring 280 to expand. Force from the spring 280 may cause the support bar 265 to move to the extended position shown in FIG. 5.

Figure 7:
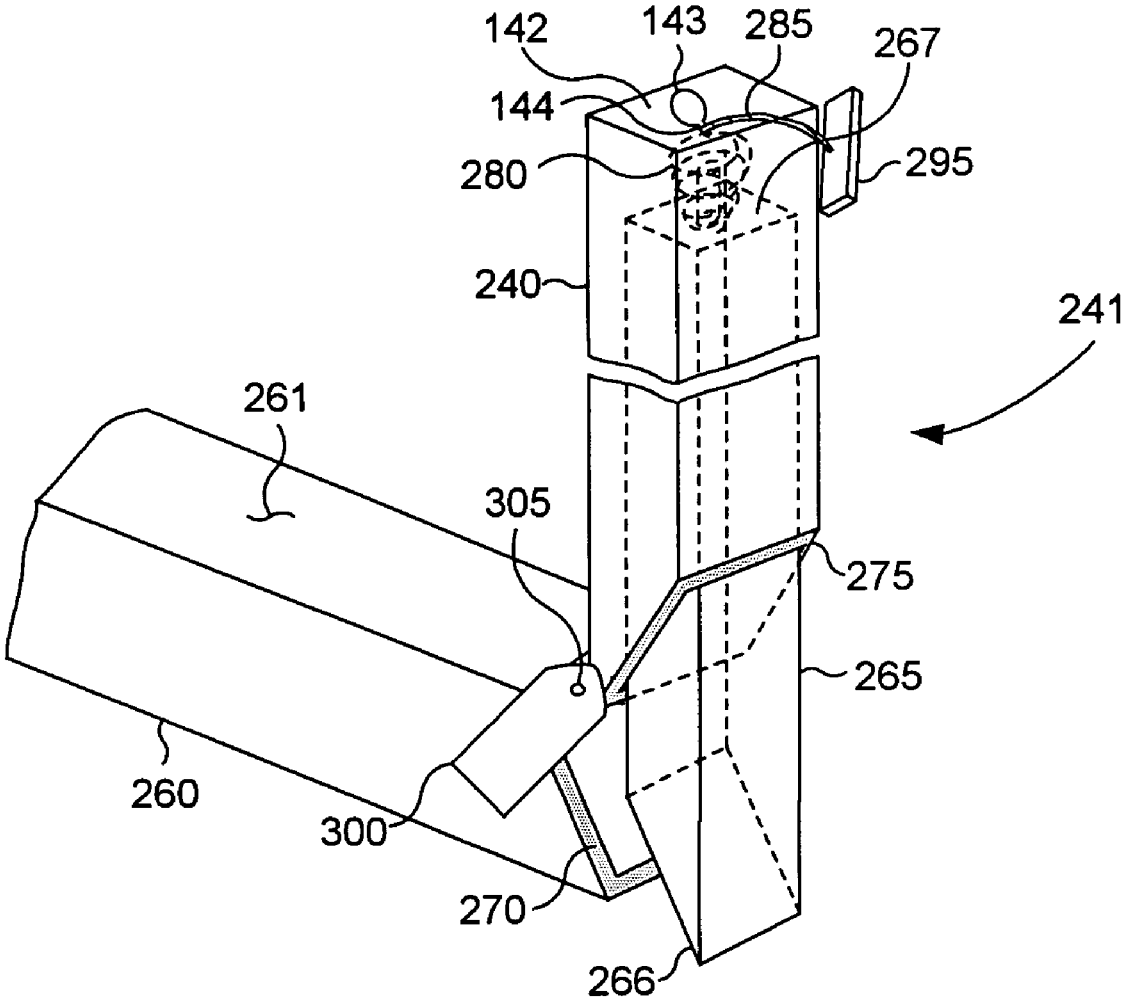
FIG. 7 is a pictorial diagram of a representative outrigger locked in a retracted, position suitable for supporting a deflated pontoon according to the present invention.

FIG. 7 is a pictorial diagram of the representative outrigger assembly 241 locked in a retracted, nominally vertical position suitable for supporting a deflated pontoon according to the present invention. As described above with respect to FIGS. 4–6, the second hollow tube 240 may have secured to the upper surface 242 thereof a sleeve 310 connected with the second hollow tube 240 by mounting brackets 315. The pin 305 may be disposed within the sleeve 310, ends of the pin 305 being secured to brackets 300, which are mounted to sides of the first hollow tube 260. The upper surface 261 of the first hollow tube 260, according to a typical embodiment, is secured to the underside 176 (FIG. 4) of the primary deck 175 of a boat 100 (FIG. 2, not shown in FIG. 7). When the support bar 265 is in a retracted position as shown in FIG. 6, a combination of the second hollow tube 240 and the support bar 265 may be free to rotate about an axis of the pin 305 to a retracted, nominally vertical position as shown in FIG. 7. Once the second hollow tube 240 is in the retracted, nominally vertical position, the tension on the connecting means 285 may be released, e.g., by removing the connecting means 285 from the slot 144 as described above, thereby allowing the support bar 265 to partially extend through action of gravity and of force from the spring 280. In the partially extended position shown in FIG. 7, the third beveled end 266 of the support bar 265 may contact and mate with the first beveled end 270 of the first hollow tube 260. The configuration illustrated in FIG. 7 is substantially rigid. Accordingly, when, for example, clockwise torque is applied to the second hollow tube 240, the beveled end 270 of the first hollow tube 260 applies a reaction force to the beveled end 266 of the support bar 265, thereby preventing the combination of the second hollow tube 240 and support bar 265 from rotating. The combination comprising the second hollow tube 240 and the support bar 265 is thereby locked with the second hollow tube 240 in a retracted, nominally vertical position. The force applied by the beveled end 270 of the first hollow tube 260 to the beveled end 266 of the support bar 265 also prevents movement of the support bar 265 in a downward direction when the representative second hollow tube 240 is placed in the retracted, nominally vertical position illustrated in FIG. 7.

Conversely, when the support bar 265 is in the extended position (cf. FIG. 5), i.e., about half inside the first hollow tube 260 and about half inside the second hollow tube 240, the combination of first hollow tube 260 and second hollow tube 240 may be held in substantially rigid relative positions by the support bar 265 although the support bar 265 may be free to move. The support bar 265, when extended, thereby effectively locks the second hollow tube 240 in an extended, nominally horizontal position when the first hollow tube 260 is secured to the underside 176 (FIG. 4) of a primary deck 175 as already described. In the locked horizontal position, the representative outrigger assembly 241 is capable of supporting weight pushing or pulling upward or downward on the representative outrigger assembly 241. In particular, as shown in FIG. 2, a plurality of outrigger assemblies 141, each of which is configured as illustrated in FIGS. 4–6, may form a portion of a support assembly 165 capable of supporting a portion of weight of a boat 100. Locking each of the plurality of outrigger assemblies 141 in an extended, nominally horizontal position in the manner just outlined for the representative outrigger assembly 241 may lock the support assembly 165 in an extended, nominally horizontal position as illustrated in FIG. 2. Conversely, the support assembly 165 may be locked in a nominally vertical position, as illustrated below in FIGS. 8 and 10–13, by locking each of the plurality of outrigger assemblies 141 in a retracted, nominally vertical position in the manner indicated above for the representative outrigger assembly 241 with reference to FIG. 7.

Figure 8:
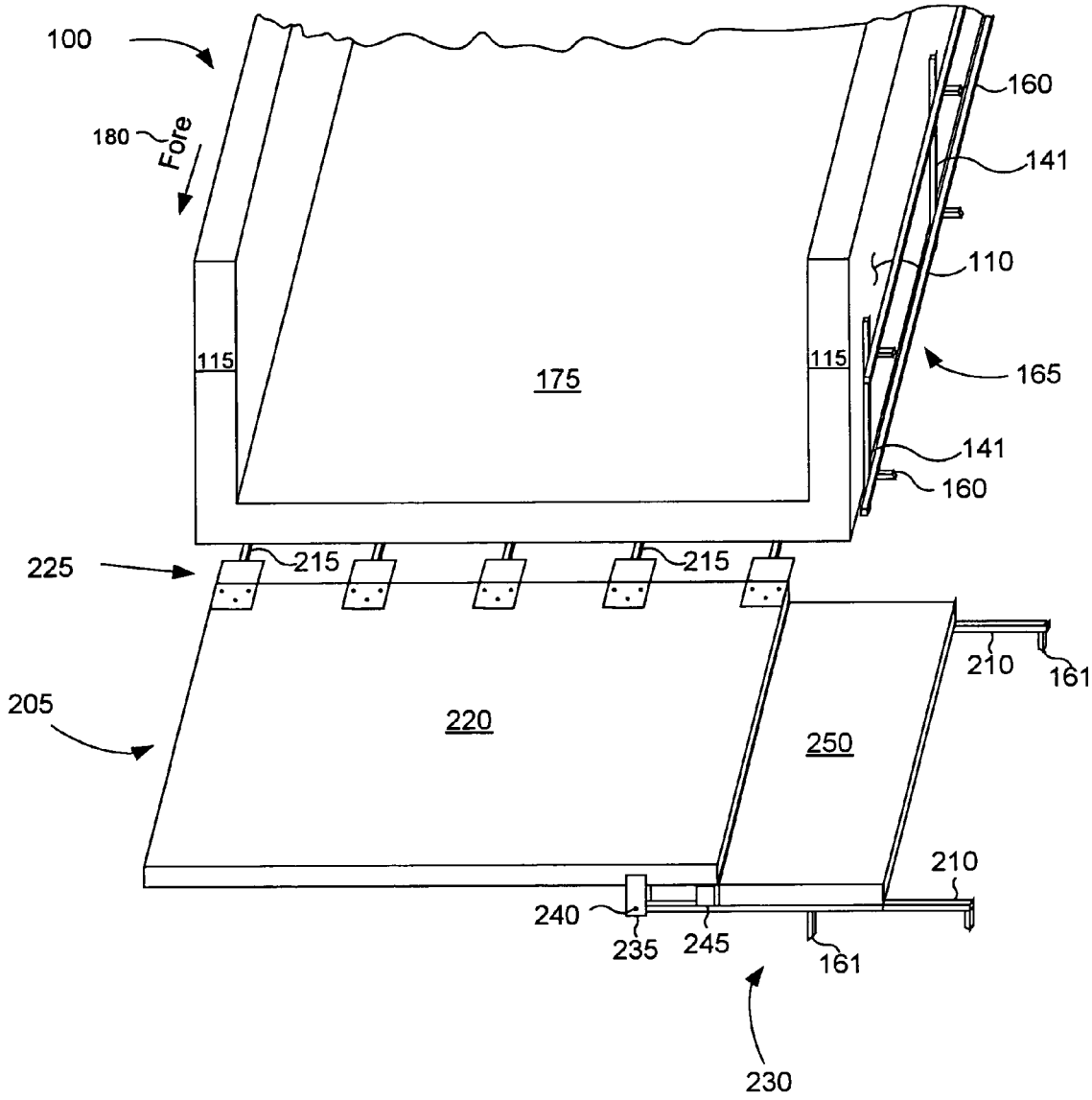
FIG. 8 is a partial pictorial diagram of a fore portion of a boat having a foldable deck assembly including a foldable wing deck assembly constructed according to the present invention.

FIG. 8 is a partial pictorial diagram of a fore portion of a boat 100 illustrating a support assembly 165 oriented in a nominally vertical position according to the present invention and further illustrating a foldable deck assembly 205 rotatably secured to the primary deck 175. In the illustrated embodiment, the foldable deck assembly 205 comprises a foldable main deck 220 and at least one foldable wing deck assembly 230. Although only one foldable wing deck assembly 230 is illustrated in FIG. 8, a typical embodiment further comprises a similar foldable wing deck assembly located on an end of the foldable main deck 220 opposite to the foldable wing deck assembly 230 shown. The foldable wing deck assembly 230 comprises a wing deck 250 to which is secured a plurality of wing deck outriggers 210 having pontoon alignment spacers 161 secured thereto, e.g., by welding or bolting. As an example, two wing deck outriggers 210 are illustrated in FIG. 8. The wing deck outriggers 210 may be rotatably secured to the wing deck portion 220 with pins 240 placed in brackets 235. (Only one pin/bracket combination is shown in FIG. 8.) Place holders 245 (only one is shown in FIG. 8) may be inserted between an underside of the wing deck 220 and the wing deck outriggers 210 in order to that an upper surface of the wing deck 220 approximately aligns with a bottom surface of the foldable main deck 220.

The foldable main deck 220 of the foldable deck assembly 205 may be secured to the primary deck 175 by support bars 215 and hinges 225. In a typical embodiment, the support bars 215 extend out from an underside of the primary deck 175 by a few inches in order to provide space for a portion of a deflated pontoon when the foldable deck assembly 205 is in a folded configuration as is more particularly described below with reference to FIGS. 12–14.

Figure 9:
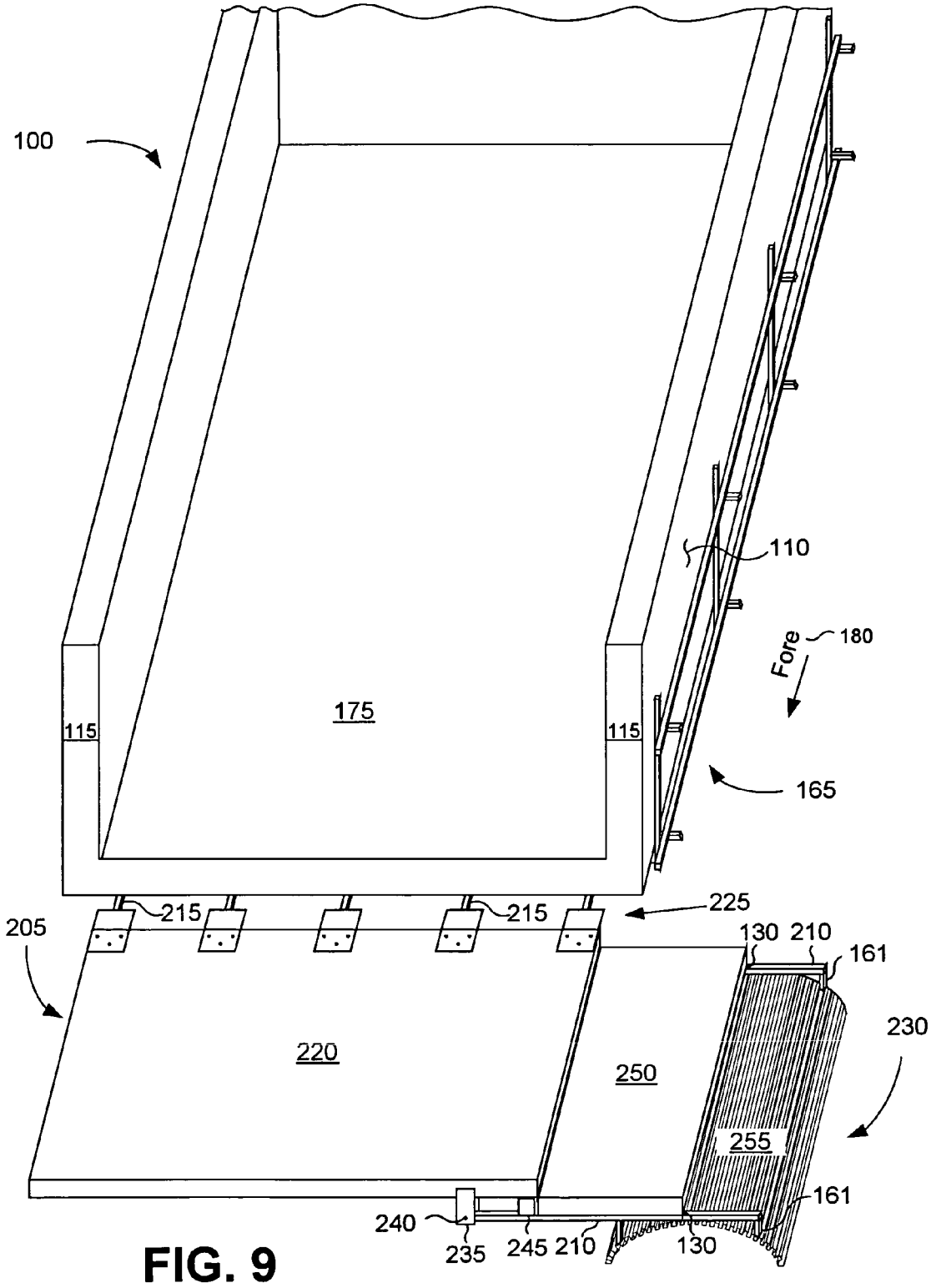
FIG. 9 is a partial pictorial diagram illustrating a wing saddle secured to wing deck outriggers of the foldable wing deck assembly illustrated in FIG. 8.

FIG. 9 is a partial pictorial diagram illustrating a wing saddle 255 formed of restraining material and secured to the wing deck outriggers 210 of the foldable wing deck assembly illustrated in FIG. 8. According to the illustrated embodiment, the wing saddle 255 is secured to wing deck outriggers 210 with bolts 130. Alternatively, the wing saddle 255 may be secured to wing deck outriggers 210 by means of a plurality of wire loops similar to the plurality of wire loops 135 as illustrated in FIG. 3.

Figure 10:
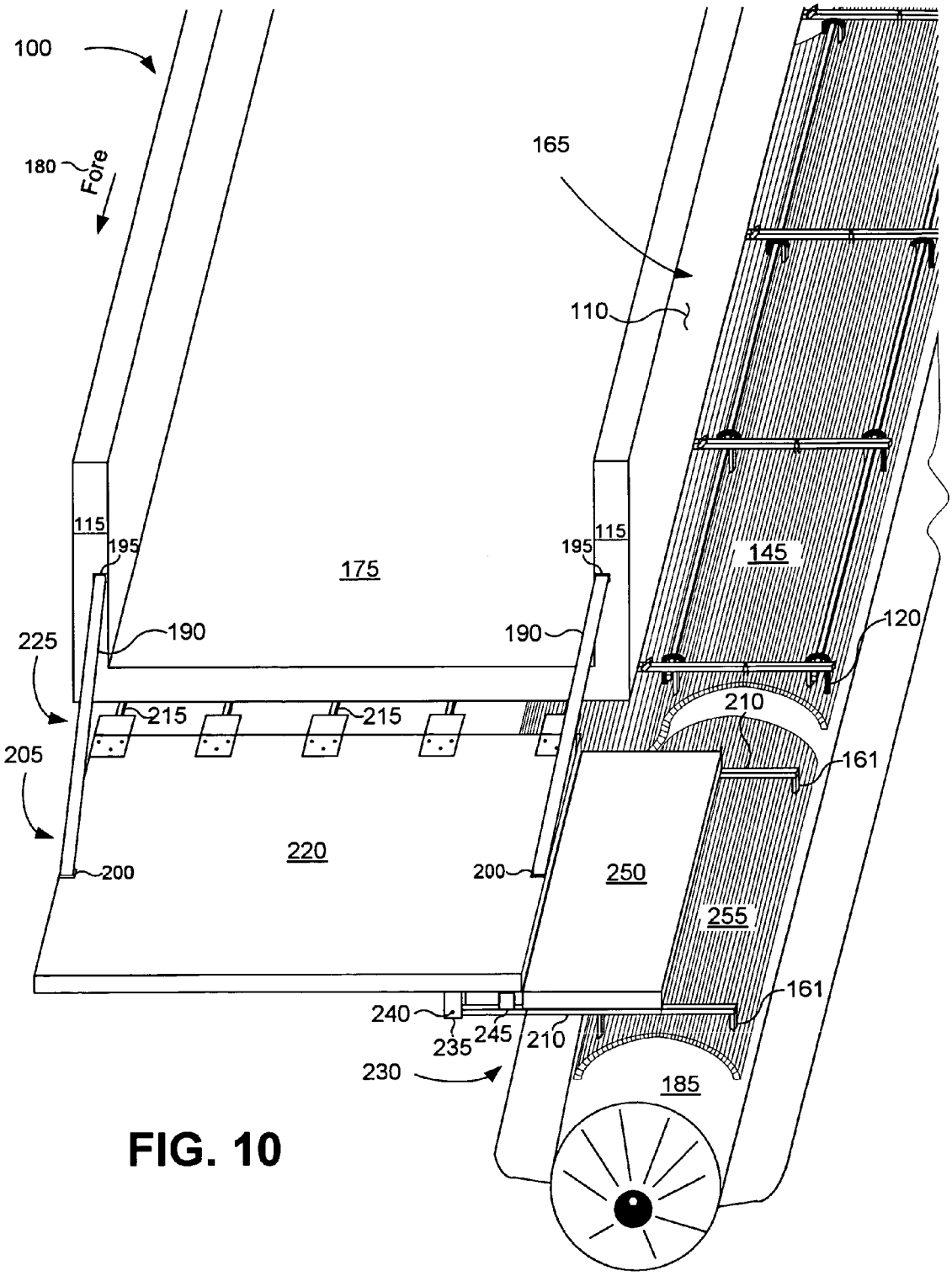
FIG. 10 is a partial pictorial diagram showing an embodiment employing a longer pontoon than that shown in FIG. 2 in order to provide support for the foldable deck assembly illustrated in FIG. 9.

FIG. 10 is a partial pictorial diagram showing an embodiment employing a longer pontoon 185 than that shown in FIG. 2 in order to provide support for the foldable deck assembly 205 illustrated in FIG. 9. The embodiment illustrated in FIG. 10 comprises a boat 100 having a primary deck 175 with sidewalls 110, the sidewalls 110 having ends 115. An inflatable pontoon 185 is secured to a support assembly 165 as described above with reference to FIG. 2. Additionally, the foldable wing deck assembly 230, including wing deck outriggers 210 and the wing saddle 255, is aligned with the support assembly 165 and with the pontoon 185. When in the water, the foldable wing deck assembly 230 may rest on an upper surface of the pontoon 185, thereby being supported by the pontoon 185. The foldable deck assembly 205 may be secured to the primary deck 175 with hinges 225 and support bars 215 as described above with reference to FIGS. 8 and 9. Braces 190 may be used to stabilize the position of the foldable deck assembly 205 relative to the primary deck 175. The braces 190 may be secured to brackets 195 mounted on the ends 115 of the sidewalls 110 and to brackets 200 mounted on an upper surface of the foldable main deck 220 of the foldable deck assembly 205. According to an exemplary embodiment, the braces 190 are secured to the brackets 195 by bolts.

FIGS. 8 and 9 illustrate the support assembly 165 (the saddle 145 and pontoon 185 illustrated in FIG. 2, are not shown in FIGS. 8 and 9 for clarity) placed in a retracted, nominally vertical position. A procedure for retracting the support assembly 165 is described above with reference to FIGS. 5–7.

Figure 11:
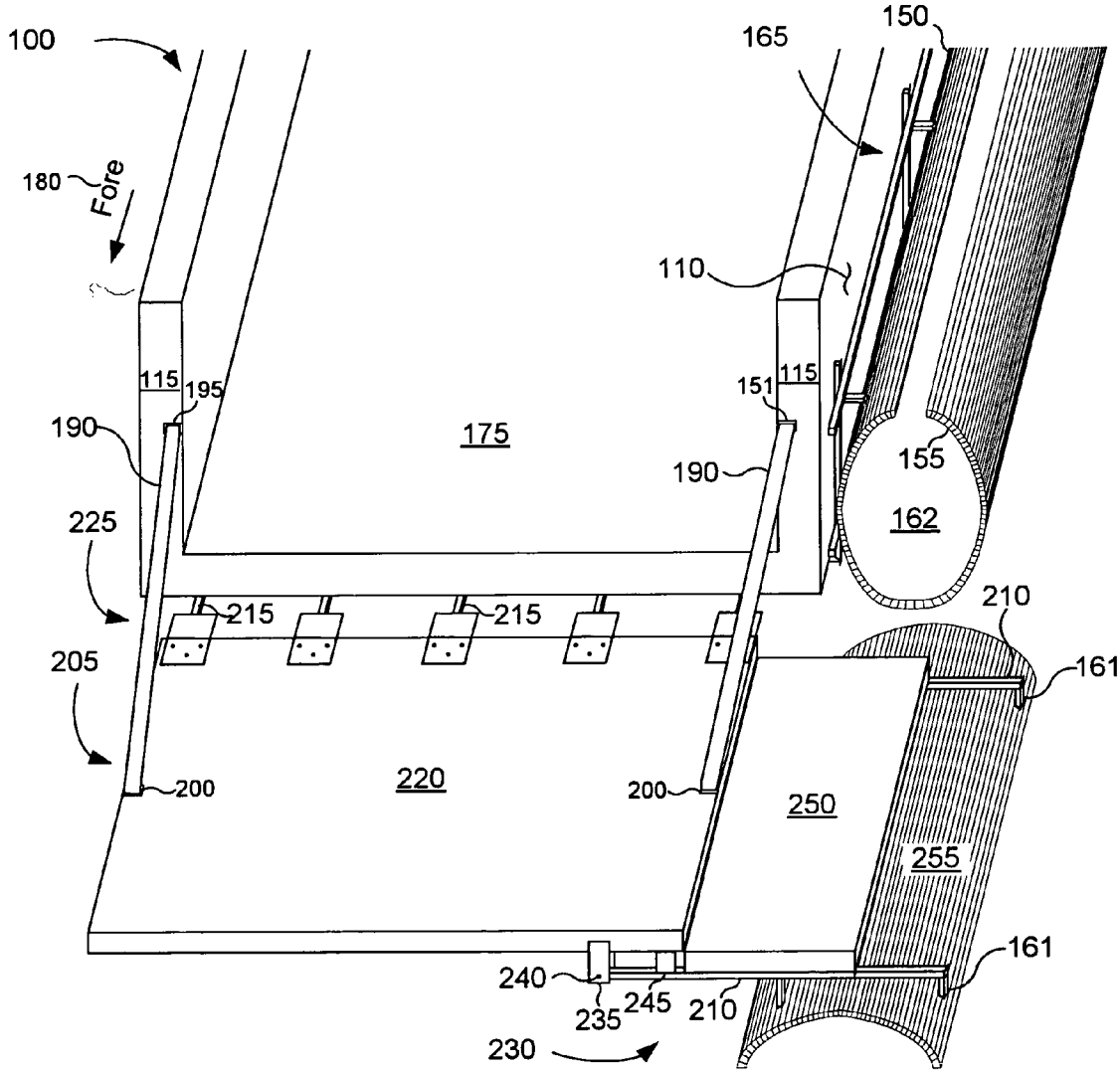
FIG. 11 is a pictorial diagram illustrating a support assembly in a retracted position with restraining material arranged to hold a deflated pontoon.

FIG. 11 is a pictorial diagram illustrating a support assembly 165 in a retracted, nominally vertical position with restraining material 150 arranged to hold a deflated pontoon. Although the pontoon is not illustrated in FIG. 11, it should be clear that a pontoon (not shown) occupying a volume 162 can be substantially surrounded by restraining material 150 including additional restraining material 155.

Figure 12:
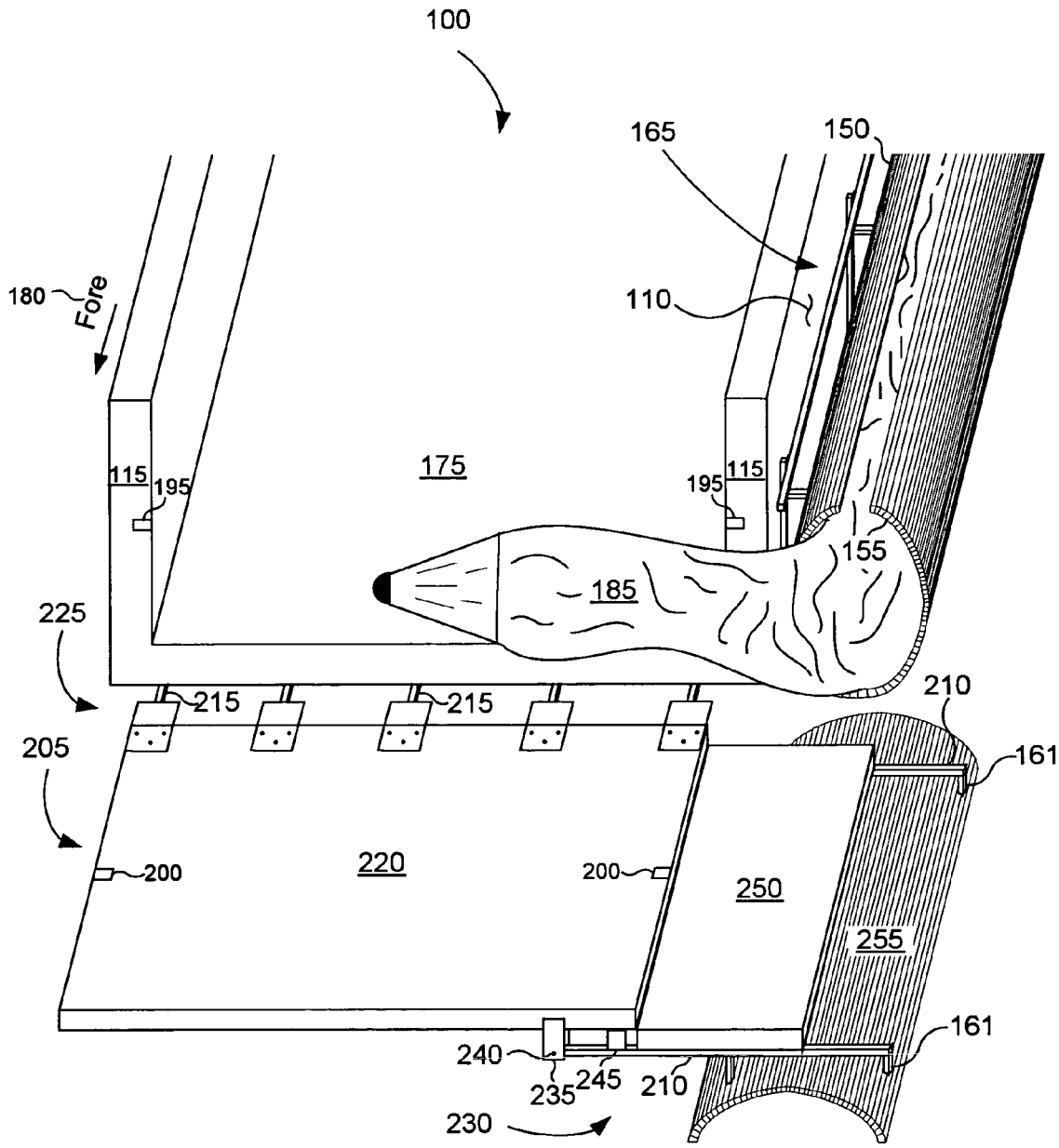
FIG. 12 is a partial pictorial diagram depicting a deflated pontoon wrapped in restraining material including additional restraining material.

FIG. 12 is a partial pictorial diagram depicting a deflated pontoon 185 wrapped in restraining material 150 including additional restraining material 155. As described above with reference to FIG. 2, about half of the restraining material 150 forms the saddle 145 (FIG. 2). The rest of the restraining material 150, designated as additional restraining material 155, may be used to substantially surround the deflated pontoon 185. In another embodiment, additional restraining material 155 is not used, and the deflated pontoons may be secured by alternative means, e.g., by bungee cords, rope, wire, or the like. It should be noted that a portion of the deflated pontoon 185 may be folded across the fore end 180 of the boat 100. The extending of the support bars 215 from the primary deck 175, as described above with reference to FIG. 8, may provide space for placing the folded portion of the pontoon 185 across the fore end 180 of the boat when the foldable deck assembly 205 is in a folded position as described below with reference to FIGS. 13 and 14. The braces 190 illustrated in FIG. 11 may be removed in order to allow the folded portion of the pontoon 185 to be placed across the fore end 180 of the boat.

Figure 13:
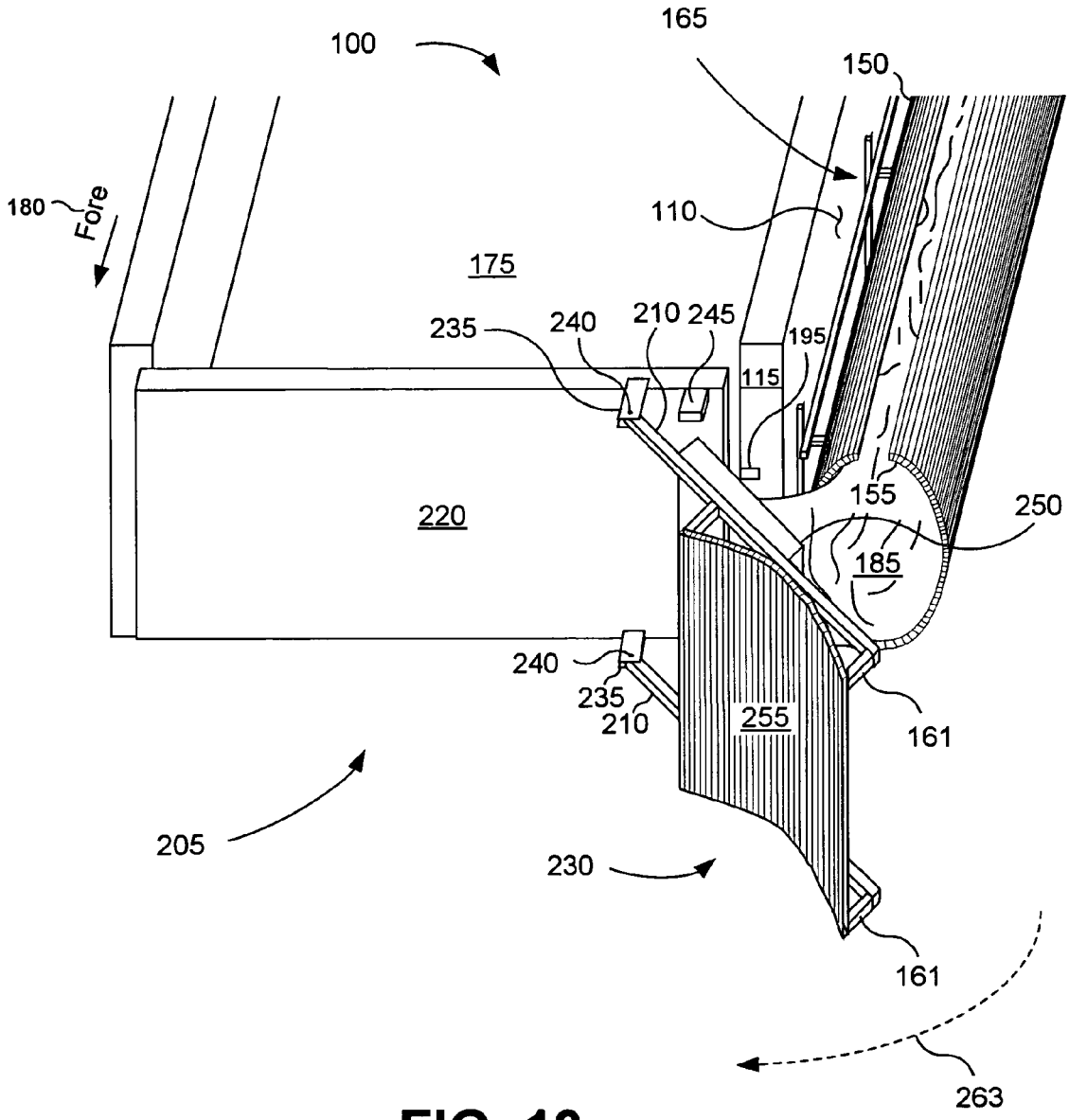
FIG. 13 is a partial pictorial diagram illustrating a foldable wing deck assembly in a partially folded position.

Once the pontoon 185 has been deflated and the braces 190 (FIG. 11) have been removed as illustrated in FIG. 12, a portion of the pontoon 185 may be folded across the fore end 180 of the boat as already described. The foldable main deck 220 of the foldable deck assembly 205 then may be folded to a nominally vertical position as illustrated in FIG. 13. It should be noted that the foldable main deck 220 can aid in restraining the folded portion of the pontoon 185 for transport, for example, on a trailer. The foldable wing deck assembly 230 then may be rotated according to rotation indication 263 about the pins 240 in brackets 235 to a folded position. The foldable wing deck assembly 230 is illustrated in FIG. 13 as being partially folded.

Figure 14:
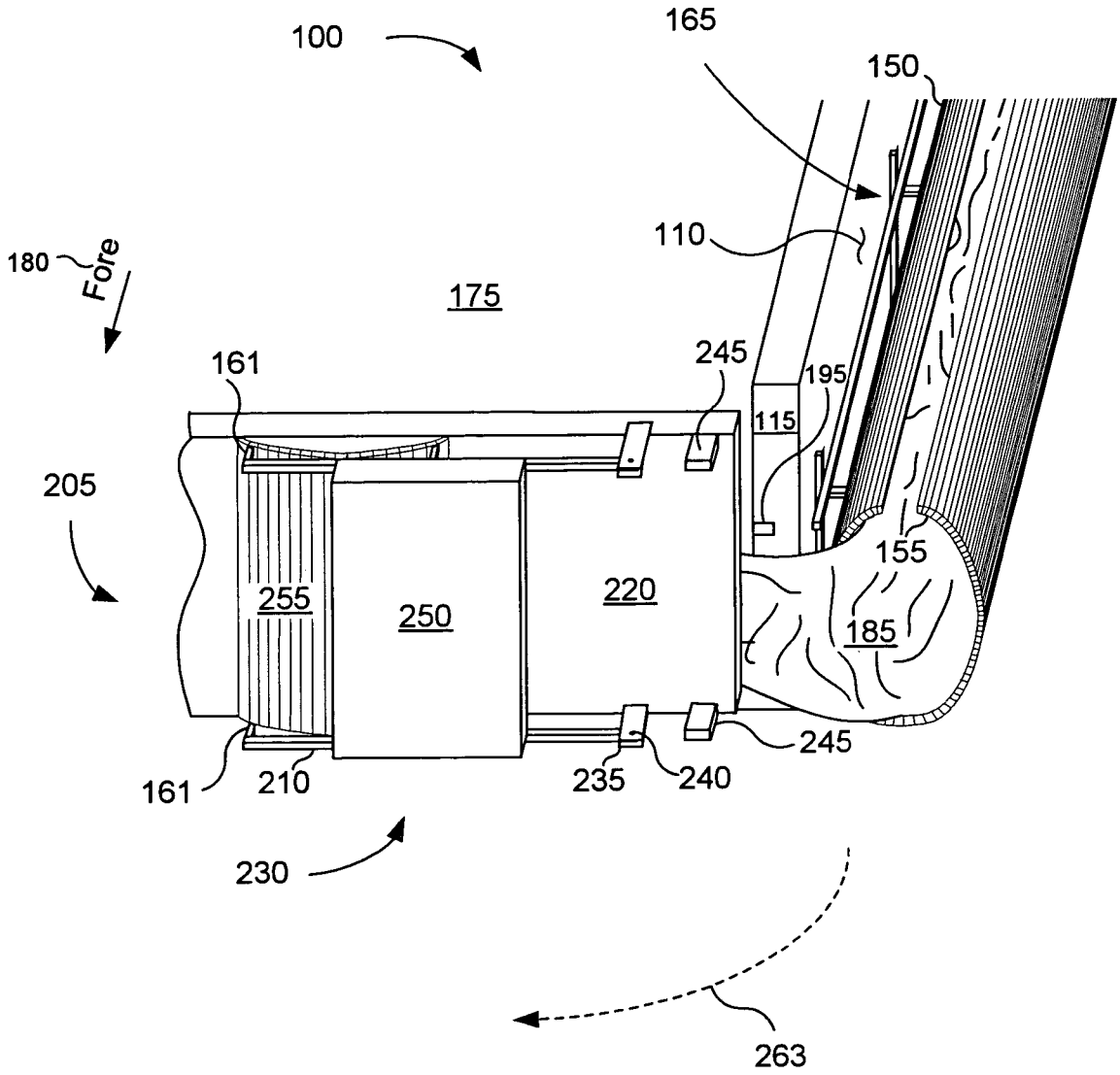
FIG. 14 is a partial pictorial diagram of a front corner of a boat illustrating a pontoon and a foldable deck assembly in a folded position suitable for transporting the boat on a trailer.

FIG. 14 is a partial pictorial diagram of a front corner of a boat 100 that illustrates the pontoon 185 and the foldable deck assembly 205 in a position suitable for transporting the boat 100 on a trailer. It should be understood that a typical embodiment includes a second pontoon placed on a sidewall opposite the sidewall 110 illustrated in FIGS. 1–2, and 8–14. The foldable deck assembly 205 in such a typical embodiment also may include a second foldable wing deck assembly mounted on an end of the foldable main deck 220 opposite the end of the foldable main deck 220 illustrated in FIG. 14 as already mentioned.

Figure 15:
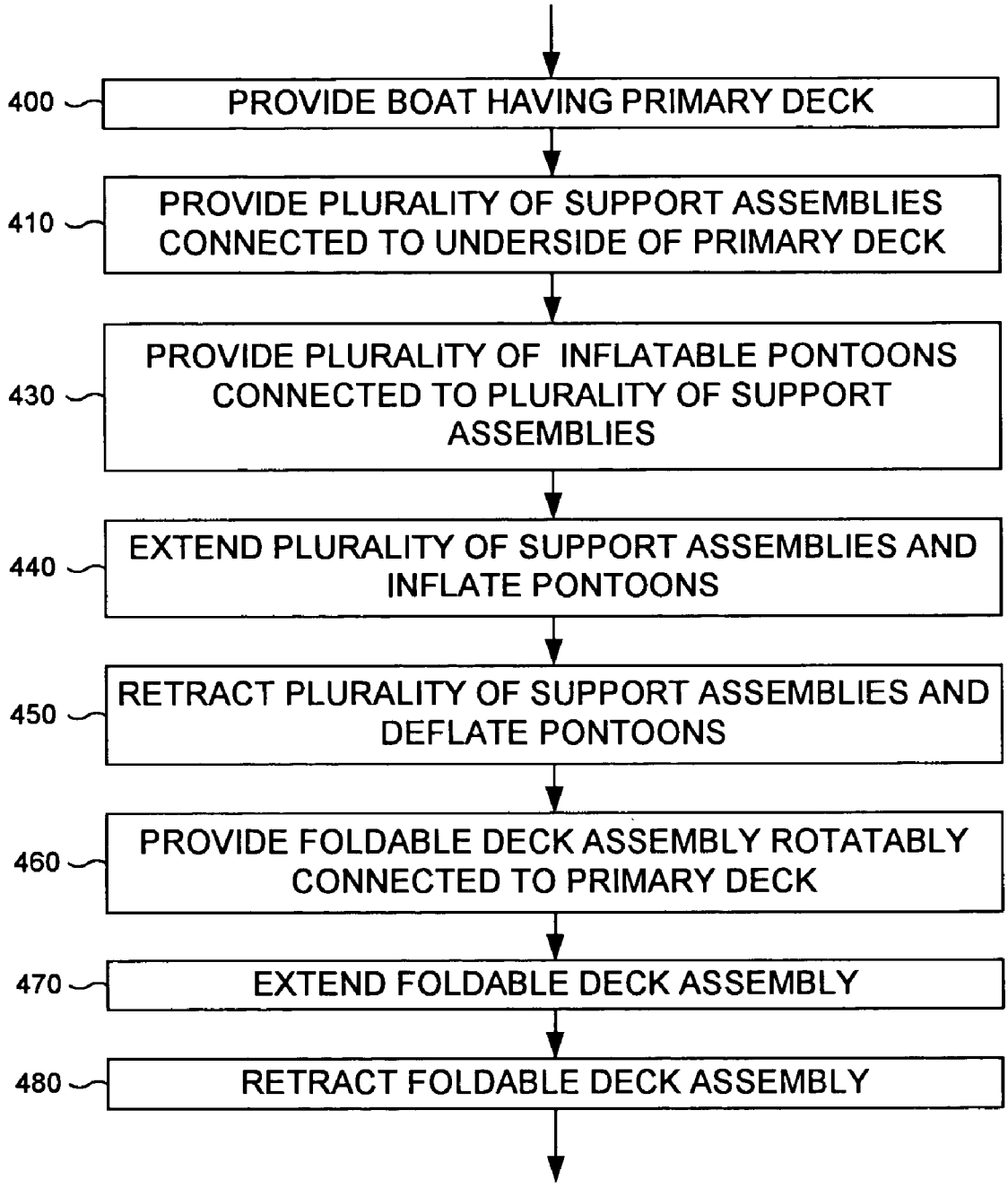
FIG. 15 is a flow diagram illustrating an implementation of the method of the present invention.

The present invention further comprises a method of extending support assemblies in a manner that facilitates operating a boat on water with a wide configuration. A variation of the method further provides for retracting the support assemblies to achieve a narrow configuration suitable for trailering the boat on a highway. FIG. 15 is a flow diagram that illustrates one implementation of the method of the present invention. According to this implementation of the method, and with reference to FIG. 1, a boat 100 is provided at step 400, the boat 100 comprising a primary deck 175. This implementation of the method of the present invention further provides a plurality of support assemblies 165 connected to an underside of the primary deck 175 at step 410. The implementation of the method further provides a plurality of inflatable pontoons 185 and 186 connected to the plurality of support assemblies 165 at step 430. The plurality of support assemblies 165 may comprise a plurality of outrigger assemblies 141, an example of which is a representative outrigger assembly 241 illustrated in FIG. 3. The representative outrigger assembly 241 may be connected, e.g., by welding, to an underside 176 of the primary deck 175 as illustrated in FIG. 4. The plurality of support assemblies 165 may be extended, and the pontoons 185 and 186 inflated at step 440. FIGS. 2 and 3 depict an inflated pontoon 185 connected with an extended support assembly 165. A boat 100 with inflated pontoons and an extended plurality of support assemblies may be advantageously operated on water owing to the relatively wide stance afforded by the extension of the support assemblies and associated pontoons. The inflated pontoon 185 illustrated in FIGS. 2 and 3 comprises a plurality of fastening loops 120 that hook over two parallel rods 170 of the support assembly 165. The two parallel rods 170 shown in, e.g., FIG. 2, underlie a plurality of outrigger assemblies 141 secured to the underside 176 (FIG. 4) of the primary deck 175, e.g., by welding.

Preparatory to transporting the boat 100 on a trailer, the plurality of inflatable pontoons 185 and 186 may be deflated and the plurality of support assemblies 165 retracted at step 450. For example, FIGS. 11–14 illustrate the support assembly 165 in a retracted position. The pontoon 185 is shown in deflated condition in FIGS. 12–14. A boat with deflated pontoons and a plurality of support assemblies in retracted position may be capable of being transported on a highway by trailer.

Figure 16:
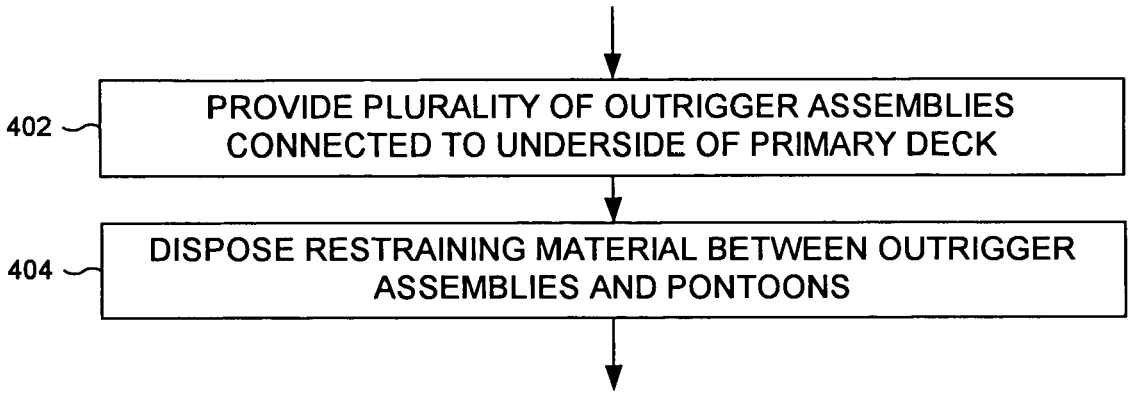
FIG. 16 is a flow diagram depicting an illustrative variation of a method for providing a plurality of support assemblies according to the present invention.

FIG. 16 is a flow diagram depicting an illustrative variation of a method for providing a plurality of support members according to the present invention. A plurality of outrigger assemblies is provided at step 402, the plurality of outrigger assemblies being connected to the underside 176 of the primary deck 175 as illustrated by the representative outrigger assembly 241 shown in FIGS. 3 and 4. Restraining material 150 (FIGS. 2 and 3) may be disposed between the plurality of outrigger assemblies and the plurality of pontoons at step 404. FIG. 2 illustrates a saddle 145 formed of restraining material 150 overlying a pontoon 185 according to the method of the present invention. According to another variation of the method of the present invention, a plurality of parallel rods 170 may be provided, the parallel rods 170 overlying the saddle 145 and underlying the plurality of outriggers 141 as illustrated in FIG. 2.

Figure 17:
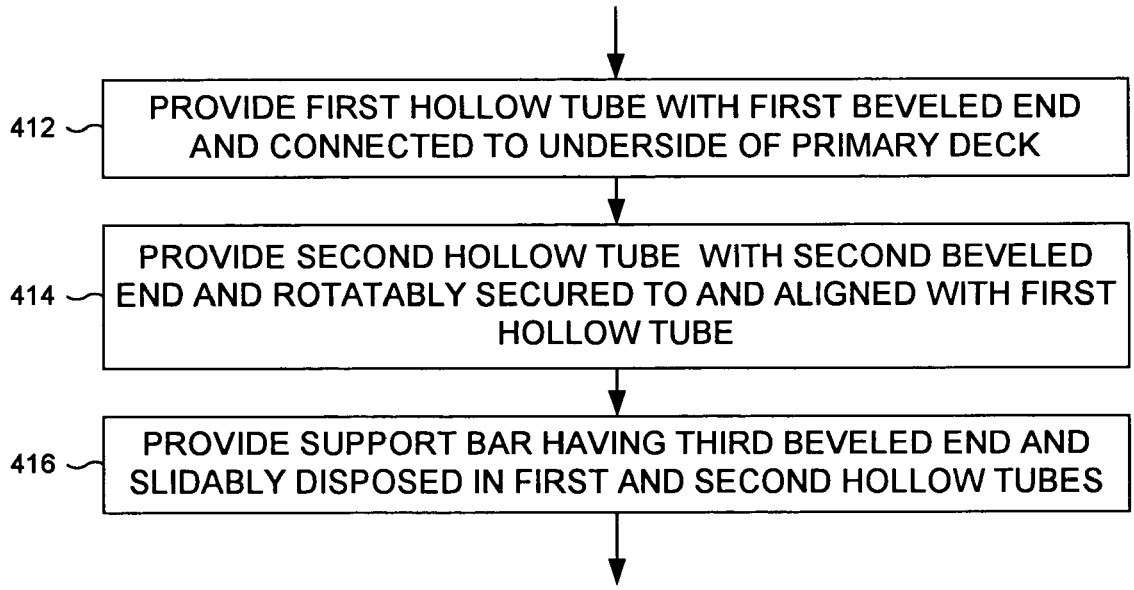
FIG. 17 is a flow diagram describing a variation of a method for providing a plurality of outriggers according to the present invention.

An implementation of the method of the present invention may provide a plurality of outriggers as described by a flow diagram presented in FIG. 17. A representative outrigger 241 illustrated in FIGS. 3–7 may be formed by providing at step 412 a first hollow tube having a first beveled end and connected to a bottom surface of primary deck 175, e.g., by welding. A second hollow tube aligned with and rotatably connected with the first hollow tube may be provided at step 414, the second hollow tube having a second beveled end. FIG. 4 illustrates an example of a first hollow tube 260 connected to a bottom surface 176 of a primary deck 175 as well as a second hollow tube 260. The first hollow tube 260 has a first beveled end 270; the second hollow tube 240 has a second beveled end 275. Returning to FIG. 17, a support bar slidably disposed within the first and second hollow tubes is provided at step 416, the support bar having a third beveled end. For example, FIG. 4 illustrates a support bar 265. The support bar 265, slidably disposed within the first hollow tube 260 and within representative second hollow tube 240, has third beveled end 266. An alternative view of the support bar 265 is shown in FIGS. 5–7.

Figure 18:
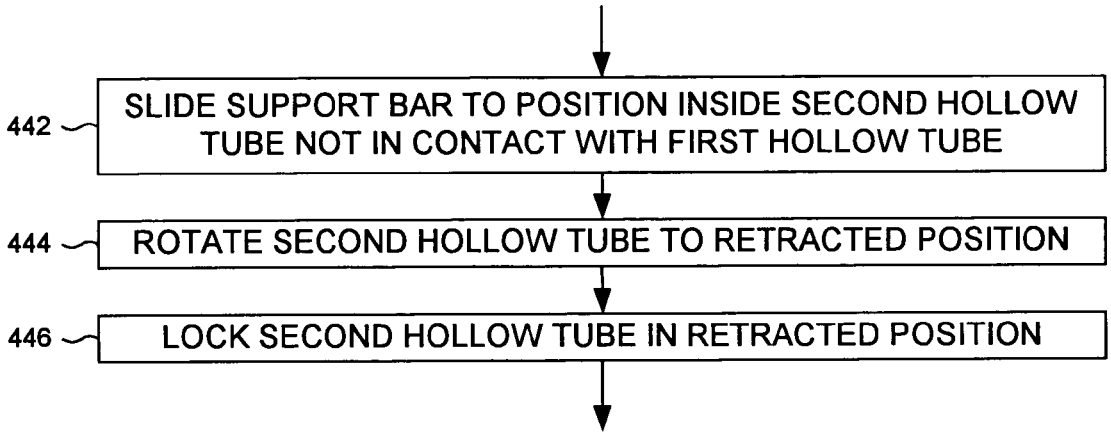
FIG. 18 is a flow diagram illustrating an implementation of a method of retracting an outrigger assembly according to the present invention.

A plurality of support assemblies (e.g. support assembly 165 illustrated in FIG. 2) may be retracted by retracting each of the plurality of outrigger assemblies individually, each support assembly including a plurality of outrigger assemblies as already described above with reference to FIG. 2. The retracting of each outrigger assembly may be accomplished, according to an implementation of the method of the present invention, as summarized by a flow diagram presented in FIG. 18. The support bar (e.g. support bar 265 as shown in FIG. 5) may be moved at step 442 to a position inside the second hollow tube whereby the support bar is clear of the first hollow tube. FIG. 6 provides an illustration of the support bar 265 disposed entirely within the second hollow tube 240 and not making contact with the first hollow tube 260. The support bar 265 may be moved, as already described above, by pulling on the handle 295, thereby applying force through the connecting means 285 to the end 267 of the support bar 265. With the support bar 265 in the position illustrated in FIG. 6, the second hollow tube 240 may be rotated to a retracted position at step 444. After rotation, the second hollow tube 240 appears as illustrated in FIG. 7. The support bar 265 then may be allowed to move downward to a position where the third beveled end makes contact with the first beveled end at step 446. For example, as illustrated in FIG. 7, the third beveled end 266 mates with and makes contact with the first beveled end 270 thereby making the outrigger 241 essentially rigid and locking the second hollow tube 240 in the retracted, position. Repeating the locking procedure with all of the plurality of outrigger assemblies may effectively lock the plurality of support assemblies in a nominally vertical position. The support bar 265 may be moved to the locking position as described above with reference to FIG. 7.

A typical implementation of the method of the present invention may include deflating the plurality of pontoons connected with the plurality of support assemblies before the plurality of support assemblies is retracted. The deflating may be accomplished using techniques well known in the art. According to another variation of the method of the present invention, the plurality of pontoons may be substantially surrounded as illustrated, e.g., in FIGS. 12–14, by restraining material 150, including additional restraining material 155 after the plurality of pontoons has been deflated. The surrounding of pontoons with restraining material may protect the plurality of pontoons when the boat is transported by trailer on a highway.

Figure 19:
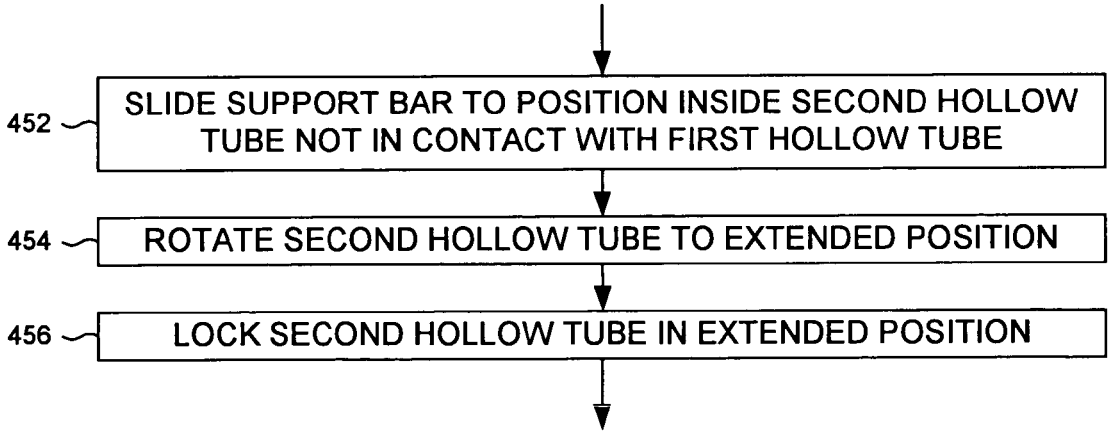
FIG. 19 is a flow diagram describing an illustrative variation of a method of extending an outrigger assembly according to the present invention.

Beginning in the nominally vertical position illustrated in FIG. 7, the representative outrigger 241 may be extended. When each outrigger assembly in the plurality of outrigger assemblies 141 illustrated, e.g., in FIG. 2 is so extended, the support assembly 165 also is extended. FIG. 19 is a flow diagram describing an illustrative variation of a method of extending an outrigger assembly according to the present invention. This variation commences by sliding the support bar of an outrigger assembly to a position inside the second hollow tube such that the support bar does not contact the first hollow tube at step 452. For example, pulling upward on the handle 295 illustrated in FIG. 7 may apply force to the end 267 of the support bar 265 through the connecting means 285, thereby raising the support bar 265 to make it clear of the first hollow tube 260. The second hollow tube 240 then may be rotated to an extended position at step 454. After the rotation, the outrigger assembly 241 may appear as illustrated in FIG. 6 with the support bar 265 disposed entirely within the second hollow tube 240 and not making contact with the first hollow tube 260. The second hollow tube then may be locked in the extended position at step 456 by moving the support bar 265 to a position substantially half inside the first hollow tube 260 and substantially half inside the second hollow tube 240 as illustrated in FIG. 5. The moving may be accomplished by moving the connecting means 285 to a position not within the slot 144 described above with reference to FIG. 5. Releasing force on the handle 295 then may permit force from the spring 280 to move the support bar 265 to a position partially within first hollow tube 260 and partially within second hollow tube 240. Extending all of the plurality of outrigger assemblies 141 (FIG. 2) effectively extends the plurality of support assemblies 165 (FIG. 2). With the plurality of support assemblies 165 extended, a variation of the method of the present invention includes inflating the plurality of pontoons 185 and 186 (FIG. 1) connected to the plurality of support assemblies 165. Procedures are well known in the art for inflating the plurality of pontoons 185 and 186.

Referring again to FIG. 15, another implementation of the method of the present invention comprises providing a foldable deck assembly rotatably connected with the primary deck of the boat at step 460. FIGS. 8–14 illustrate an exemplary embodiment of a foldable deck assembly 205. The providing of a foldable deck assembly 205 may comprise, according to a typical variation of the method, providing a foldable main deck, e.g. the foldable main deck 220 illustrated in FIG. 8. This variation of the method further may provide at least one foldable wing deck assembly such as the foldable wing deck assembly 230 likewise illustrated in FIG. 8. Another variation of the method still further may comprise extending the foldable deck assembly at step 470 and retracting the foldable deck assembly at step 480. Typically, the foldable deck assembly is retracted for transporting the boat by trailer. Conversely, the foldable deck assembly normally is extended when the boat is operated on water.

Figure 20:
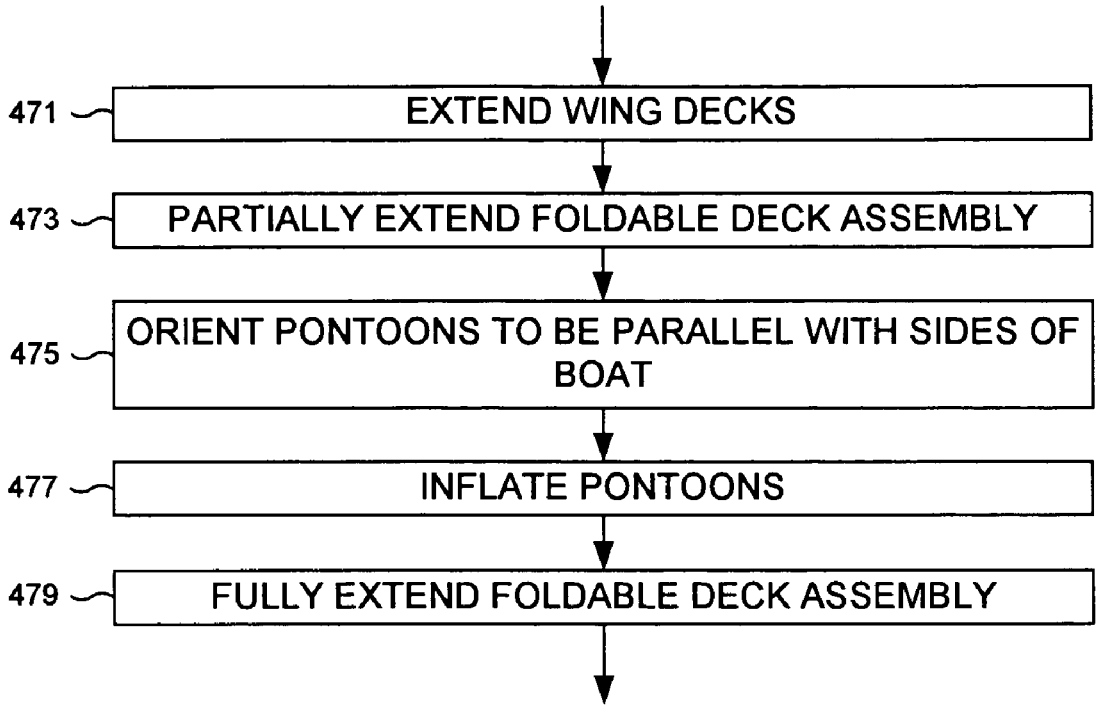
FIG. 20 is a flow diagram describing an implementation of a method of extending a foldable deck assembly according to the present invention.

FIG. 20 is a flow diagram that describes a variation of a method of extending a foldable deck assembly according to the present invention. With reference to the embodiment illustrated in FIGS. 8, 10, 12, 13, and 14, the foldable deck assembly 205 may be extended by beginning with the foldable deck assembly 205 retracted as illustrated in FIG. 14. The at least one foldable wing deck assembly 230 may be extended at step 471 by rotating the foldable wing deck assembly 230 in a direction opposite to rotation direction 263. In typical embodiments, two foldable wing deck assemblies may be provided, although only one foldable wing deck assembly 230 is shown in FIGS. 8, 10, 12, 13, and 14 for simplicity. With the foldable wing deck assembly 230 fully extended, the foldable deck assembly 205 may be partially extended at step 473 by rotating the foldable deck assembly 205 downward from a top of the boat 100. Typically, any portion of pontoons (e.g. the pontoon 185 illustrated in FIG. 12) then may be moved at step 475 from the fore end 180 of the boat 100 so that the pontoons are parallel with the sides (e.g. side 110 in FIG. 12) of the boat 100. Normally, the plurality of support assemblies 165 (FIG. 2) is then extended as described above. The plurality of pontoons 185 and 186 (FIG. 1) then may be inflated at step 477. The foldable deck assembly 205 then may be fully extended at step 479 by rotating the foldable main deck 220 to a nominally horizontal position as illustrated in FIG. 10. Optionally, braces 190 may be connected to the extended foldable deck assembly 205 to stabilize the foldable deck assembly 205.

Figure 21:
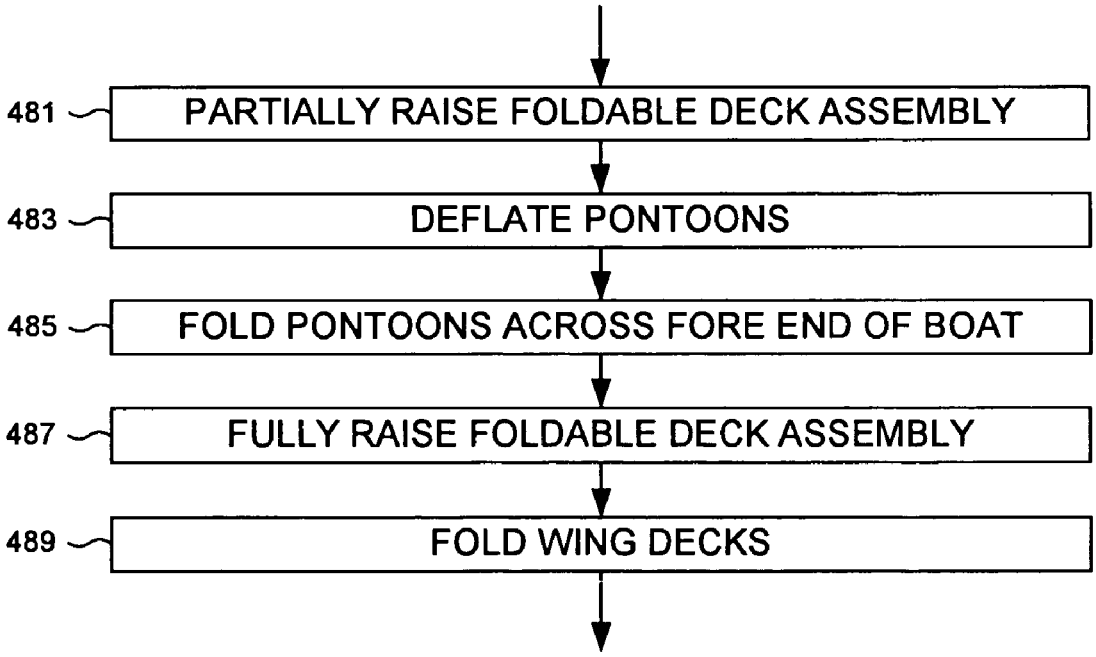
FIG. 21 is a flow diagram depicting a variation of a method of retracting a foldable deck assembly in accordance with the present invention.

The foldable deck assembly 205 may be retracted by substantially reversing the steps just outlined for extending the foldable deck assembly 205 as illustrated in the flow diagram of FIG. 21. A normal variation of the method of the present invention comprises partially raising the foldable deck assembly 205 (see, e.g., FIG. 10) at step 481, thereby exposing the inflated plurality of pontoons, e.g., pontoon 185. If braces 190 are employed, they may be removed before the foldable deck assembly 205 is partially raised. The plurality of pontoons then may be deflated at step 483 using methods well understood in the art. For convenience in transporting the boat 100 on a trailer, a portion of pontoons (e.g. pontoon 185) may be folded across the fore end 180 of the boat 100 as illustrated in FIG. 12. The foldable deck assembly 205 then may be fully raised at step 487 to a nominally vertical position as illustrated in FIG. 13. The at least one foldable wing deck assembly 230 then may be folded by rotating the foldable wing deck assembly 230 according to rotation indication 263 as illustrated in FIGS. 13 and 14 to a position nominally adjacent to the foldable main deck 220. Retracting the foldable deck assembly 205 may further facilitate the transportation of the boat 100 on a trailer.

In view of the foregoing, it will be understood by those skilled in the art that the methods of the present invention can facilitate fabrication and operation of collapsible watercraft. The above-described embodiments have been provided by way of example, and the present invention is not limited to these examples. Multiple variations and modification to the disclosed embodiments will occur, to the extent not mutually exclusive, to those skilled in the art upon consideration of the foregoing description. Additionally, other combinations, omissions, substitutions and modifications will be apparent to the skilled artisan in view of the disclosure herein. Accordingly, the present invention is not intended to be limited by the disclosed embodiments, but is to be defined by reference to the appended claims.

What is claimed is:

1. A collapsible boat, comprising:

a primary deck;

a foldable main deck extending from the primary deck, the foldable main deck being hingedly attached to the primary deck and movable between a substantially vertical orientation and a substantially horizontal orientation;

a plurality of support assemblies connected to a lower surface of the primary deck, each support assembly further comprising a plurality of outrigger assemblies extending outward from sides of the boat, each outrigger assembly movable between a retracted position and an extended position;

a plurality of inflatable pontoons connected to the plurality of support assemblies, wherein the plurality of support assemblies, when assuming the extended position, and with the plurality of inflatable pontoons inflated, is adapted to support the boat above a surface of water; and wherein the boat, with the plurality of support assemblies assuming the retracted position, and with the plurality of inflatable pontoons deflated, is capable of being transported on a trailer.

2. The boat as set forth in claim 1, further comprising a plurality of parallel rods disposed substantially perpendicular to and underlying the plurality of outrigger assemblies.

3. The boat as set forth in claim 2, further comprising restraining material underlying the plurality of outrigger assemblies and overlying the plurality of inflatable pontoons.

4. The boat as set forth in claim 1, wherein each outrigger assembly comprises:

a first hollow tube secured to the lower surface of the primary deck;

a second hollow tube aligned with the first hollow tube, the second hollow tube being rotatably secured to the first hollow tube; and a support bar slidably disposed within the first and second hollow tubes.

5. The boat as set forth in claim 4, wherein:

the first hollow tube comprises a first beveled end;

the second hollow tube comprises a second beveled end capable of mating with the first beveled end; and the support bar comprises a third beveled end oriented at a nominal right angle with the second beveled end.

6. The boat as set forth in claim 5, wherein:

the support bar is capable of siding side the first and second hollow tubes to a position clear of the first hollow tube;

the second hollow tube is capable of being rotated to a retracted position when the support bar is clear of the first hollow tube; and the support bar is capable of being moved to a position in which the third beveled end mates with the first beveled end when the second hollow tube is in the retracted position, whereby the second hollow tube is locked in the retracted position.

7. The boat as set forth in claim 1, further comprising:

at least one foldable wing assembly secured to the flowable main deck.

8. The boat as set forth in claim 7, wherein the at least one foldable wing deck assembly comprises:

a wing deck; and a plurality of wing deck outriggers secured to the wing deck.

9. A method of providing a collapsible boat, comprising the steps of:

providing a boat having a primary deck;

providing a foldable main deck extending from the primary deck, wherein the foldable main deck is hingedly attached to the primary deck and movable between a substantially vertical orientation and a substantially horizontal orientation;

providing a plurality of support assemblies connected to an underside of the primary deck; wherein each support assembly comprises a plurality of outrigger assemblies extending outward from sides of the boat;

providing a plurality of inflatable pontoons connected to the plurality of support assemblies, wherein restraining material is disposed between the plurality of outrigger assemblies and the plurality of inflatable pontoons;

extending the plurality of support assemblies and inflating the plurality of inflatable pontoons, thereby raising the boat above a surface of water to render the boat usable on water; and retracting the plurality of support assemblies and deflating the plurality of inflatable pontoons, thereby rendering the boat transportable by trailer.

10. The method as set forth in claim 9, wherein the providing of a plurality of outrigger assemblies comprises:

providing, for each outrigger assembly, a first hollow tube having a first beveled end, the fist hollow tube being connected to an underside of the primary deck;

providing, for each outrigger assembly, a second hollow tube rotatably secured to and aligned with the first hollow tube, the second hollow tube having a second beveled end; and providing, for each outrigger assembly, a support bar slidably disposed within the first hollow tube and within the second hollow tube, the slidable support bar having a third beveled end oriented at a nominal right angle with the second beveled end.

11. The method as set forth in claim 10, wherein the extending comprises:

sliding the support bar in each outrigger assembly to a position within the second hollow tube, whereby the support bar is not in contact with the first hollow tube;

rotating the second hollow tube to an extended, nominally horizontal position;

locking the second hollow tube in the extended, nominally horizontal position; and inflating the plurality of pontoons.

12. The method as set forth in claim 11, wherein the locking comprises sliding the support bar to a position whereby a first substantially portion of the support bar lies within the first hollow tube and a second substantial portion of the support bar lies within the second hollow tube.

13. The method as set forth in claim 10, wherein the retracting comprises:

sliding the support bar in each outrigger assembly to a position within the second hollow tube, whereby the support bar is not in contact with the first hollow tube;

rotating the second hollow tube in each outrigger assembly to a retracted position; and locking the second hollow tube in each outrigger assembly in the retracted position, thereby locking the second hollow tube in the retracted position.

14. The method as set forth in claim 9, further comprising substantially surrounding the plurality of pontoons with the restraining after deflating the plurality of pontoons.

15. The method as set forth in claim 9, wherein the providing of a boat comprises:

providing at least one foldable wing deck assembly rotatably connected to the foldable main deck.

16. An outrigger assembly of a boat comprising:

a first hollow tube having a first beveled end;

a second hollow tube aligned with and rotatably secured to the first hollow tube, the second hollow tube having a second beveled end capable of mating with the first beveled end; and a support bar slidably dosed within the fist hollow tube and the second hollow tube, the support bar having a third beveled end oriented at a nominal right angle to the second beveled end.

17. The outrigger assembly as set forth in claim 16, wherein the outrigger assembly is capable of being configured in one of an extended and a retracted position and wherein:

the first hollow tube assumes a reference position;

the second hollow tube assumes a position nominally perpendicular to the reference position with the support bar disposed substantially within the second hollow tube when the outrigger assembly is configured in the retracted position; and the second hollow tube assumes a position nominally aligned with and extended from the first hollow tube, the support bar being disposed about half within the first hollow tube and about half within the second hollow tube when the outrigger assembly is configured in the extended position.

18. The outrigger assembly as set forth in claim 17, wherein the third beveled end mates with and makes contact with the first beveled end when the outrigger assembly is configured in the retracted position, the contact essentially locking the outrigger assembly in the retracted position.

* * * * *